US011454438B2

(12) United States Patent
Njaastad et al.

(10) Patent No.: US 11,454,438 B2
(45) Date of Patent: Sep. 27, 2022

(54) SPACE SAVING ICE AND BEVERAGE DISPENSER WITH ACCESSIBLE AUGER DRIVE

(71) Applicant: Marmon Foodservice Technologies, Inc., Osseo, MN (US)

(72) Inventors: David K. Njaastad, Palatine, IL (US); Andrew J. Tobler, Geneva, IL (US); Shishirdas K. Ravindran, Kerala (IN); E. Scott Sevcik, Crystal Lake, IL (US); Carmelo Hernandez, Harvard, IL (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 188 days.

(21) Appl. No.: 16/941,733

(22) Filed: Jul. 29, 2020

(65) Prior Publication Data

US 2021/0033329 A1 Feb. 4, 2021

Related U.S. Application Data

(60) Provisional application No. 62/969,986, filed on Feb. 4, 2020, provisional application No. 62/879,821, filed on Jul. 29, 2019.

(51) Int. Cl.
*F25C 5/20* (2018.01)
*B67D 1/00* (2006.01)

(52) U.S. Cl.
CPC ..... *F25C 5/24* (2018.01); *B67D 1/0021* (2013.01)

(58) Field of Classification Search
CPC ..... F25C 2400/12; F25C 5/24; B67D 1/0021; B67D 1/0857
See application file for complete search history.

(56) References Cited

U.S. PATENT DOCUMENTS

| | | | |
|---|---|---|---|
| 3,715,119 | A | 2/1973 | Shelley et al. |
| 4,189,063 | A | 2/1980 | Matthiesen |
| 4,619,380 | A | 10/1986 | Brooks |
| 4,641,763 | A | 2/1987 | Landers et al. |
| 5,037,004 | A | 8/1991 | Katz et al. |
| 5,299,716 | A | 4/1994 | Hawkins et al. |
| 5,829,646 | A | 11/1998 | Schroeder et al. |
| 5,845,815 | A | 12/1998 | Vogel |

(Continued)

FOREIGN PATENT DOCUMENTS

WO 2007054166 5/2007

*Primary Examiner* — Filip Zec
(74) *Attorney, Agent, or Firm* — Andrus Intellectual Property Law, LLP

(57) ABSTRACT

An ice dispensing system is provided. The system includes multiple sidewalls forming an ice bin cavity configured to store ice. The system further includes an auger drive assembly. The auger drive assembly includes a drive assembly that is coupled to one of the multiple sidewalls and has a motor configured to rotate a drive gear. The auger drive assembly further includes an auger assembly positioned within the ice bin cavity. The auger assembly includes a helical auger coupled to an auger gear. The drive gear is configured to mate with the auger gear to drive rotation of the helical auger and cause ice to be dispensed through an ice chute. The drive assembly is additionally configured to move relative to the auger assembly between a closed position and an opened position. The opened position permits removal of the auger assembly from the ice bin cavity.

25 Claims, 18 Drawing Sheets

(56) References Cited

U.S. PATENT DOCUMENTS

| | | | | |
|---|---|---|---|---|
| 7,575,185 | B2 | 8/2009 | Hammonds et al. | |
| 8,756,950 | B2 | 6/2014 | Brunner et al. | |
| 8,881,952 | B1 | 11/2014 | Dickson, Jr. et al. | |
| 9,249,006 | B2 | 2/2016 | Tobler | |
| 9,285,149 | B2 | 3/2016 | Bamberger et al. | |
| 9,989,293 | B1 | 6/2018 | Dickson, Jr. et al. | |
| 10,288,336 | B2 | 5/2019 | Kessler et al. | |
| 2001/0025861 | A1* | 10/2001 | Jaleel | B67D 1/06 222/413 |
| 2003/0101735 | A1* | 6/2003 | Teague | B67D 1/0021 62/70 |
| 2004/0118872 | A1* | 6/2004 | Romanyszyn | B67D 1/0057 222/129.1 |
| 2010/0044391 | A1 | 2/2010 | Fallon et al. | |
| 2017/0268813 | A1 | 9/2017 | Abbas et al. | |
| 2018/0135762 | A1 | 5/2018 | Mastro et al. | |

* cited by examiner

SPACE SAVING ICE AND BEVERAGE DISPENSER WITH ACCESSIBLE AUGER DRIVE

CROSS-REFERENCE TO RELATED APPLICATIONS

The present application claims priority to U.S. Provisional Patent Application Ser. No. 62/879,821 filed Jul. 29, 2019, U.S. Provisional Patent application Ser. No. 62/969,986 filed Feb. 4, 2020, and Indian Patent Application 202021020264 filed May 13, 2020, the disclosures of which are incorporated herein by reference.

FIELD

The present disclosure relates to ice and beverage dispensing machines with wire augers and assemblies thereof.

BACKGROUND

The following U.S. patents provide background information and are incorporated by reference in their entireties:

U.S. Pat. No. 4,641,763 discloses an ice and beverage dispensing apparatus with a dual purpose liner. Ice from an ice-making source is loaded into a bin and rests upon a curved liner which is spaced above the bottom of the bin. Ice is moved through the bin and above the liner by a wire auger toward a discharge opening. Ice gravitationally feeds through openings in the liner to a cold plate which forms the bottom of the bin. The ice chills the cold plate, chilling beverages flowing through passages in the cold plate. As ice resting on the cold plate takes up heat, the ice melts. Water is drained from above the cold plate. Foamed-in-place polyurethane insulation surrounds the bin. A motor is mounted on the front of the bin. A drive connected to the motor drives the ice-moving auger and discharge equipment. A motor controller is mounted near an ice-discharge chute. Beverage-dispenser valves are connected to the front of the cold plate and are aligned with the dispenser chute.

U.S. Pat. No. 5,299,716 discloses an apparatus for dispensing both ice and chilled beverages, and more particularly an improved chilled beverage dispenser which has larger ice storage capacity and which incorporates an improved system of dispensing ice. The improved ice storage and dispensing system utilizes a circular rotating tray and a paddle wheel positioned in an intermediate cone chute to dispense ice efficiently and in a regulated flow in combination with chilled beverages.

U.S. Pat. No. 8,881,952 discloses an ice dispensing assembly that includes a hopper, a metering disk, a shelf member, and a separating wall. The hopper includes an outlet opening defined in a bottom end of the hopper, and an ice inlet defined in a top end of the hopper. The metering disk is positioned in the hopper and includes a plurality of cavities. The shelf member is arranged to at least partially shield the cavities from a supply of ice held in the hopper. The metering disk is rotatable relative to the hopper between a first position wherein at least one cavity is exposed to the supply of ice to be filled with ice, and a second position wherein the cavity is separated from the supply of ice by the separating wall and ice in the cavity is dispensed through the outlet opening.

U.S. Pat. No. 9,249,006 discloses a beverage dispenser that uses a slurry ice bath to achieve heat transfer from coils containing a beverage. The invention provides a hopper into which a slurry ice bath is created. The hopper receives ice from an ice bin via an ice chute. The ice bin contains a rotating agitator for pushing ice down the ice bin. Coils containing a beverage to be dispensed are submersed in the slurry ice bath. Ice passing through the ice chute and into the hopper floats to the surface of the water in the hopper. As the agitator rotates, it continues to push ice down the ice chute, which in turn raises the water level of the water in the hopper. The water level then reaches an equilibrium level, where the buoyant force of the ice in the water will prevent additional ice from falling through the ice chute.

U.S. Pat. No. 9,285,149 discloses an automated ice dispenser that decouples the action of agitating ice stored in an ice bin and the action of dispensing the ice and, additionally, uses a controlled action to dispense the ice. Agitation is achieved with a horizontally mounted agitator. Ice is dispensed with a horizontally mounted auger. The ice dispenser uses the force created by the auger to push the ice through an opening and out of the bin, making the dispensing more consistent and providing the ability to overcome clumping. By making the agitation action independent of the dispensing action, the incidence of clumping is reduced. Agitation is controlled by software, whereunder the agitator turns on based on the cumulative run time of the auger. Auger run time and agitation time (as well as other configurable parameters) are adjustable by DIP switches on a control board.

U.S. Pat. No. 10,288,336 discloses an ice delivery device that includes a bin for storing ice, a rotatable helical auger for delivering ice, and a rotatable agitator wheel with multiple flexible arms to help break up agglomerations of ice. The agitator wheel is mounted such that as the auger is rotated the auger successively engages arms of the agitator wheel to rotate the agitator wheel. If the agitator wheel encounters an obstruction, such as a mass of agglomerated ice, the auger displaces the flexible arm out of the plane of the agitator wheel thus permitting the auger to continue rotate to deliver ice. The agitator wheel is mounted on a pair of flexible liners, which are displaceable by agglomerated ice.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to example of the present disclosure, an ice dispensing system is provided. The system includes multiple sidewalls forming an ice bin cavity configured to store ice. The system further includes an auger drive assembly. The auger drive assembly includes a drive assembly that is coupled to one of the multiple sidewalls and has a motor configured to rotate a drive gear. The auger drive assembly further includes an auger assembly positioned within the ice bin cavity. The auger assembly includes a helical auger coupled to an auger gear. The drive gear is configured to mate with the auger gear to drive rotation of the helical auger and cause ice to be dispensed through an ice chute. The drive assembly is additionally configured to move relative to the auger assembly between a closed position and an opened position. The opened position permits removal of the auger assembly from the ice bin cavity.

According to another example of the present disclosure, an ice dispensing system is provided. The system includes multiple sidewalls forming an ice bin cavity configured to store ice, an inclined ice ramp located within the ice bin cavity and proximate a dispensing chute positioned at a front end of the ice bin cavity, and a helical auger situated above the inclined ice ramp and configured to be rotated by a motor. Rotation of the helical auger in a first direction causes ice to be driven upwardly along the inclined ice ramp and to exit the ice dispensing system through the dispensing chute. The ice dispensing system further includes a baffle positioned above the helical auger and the inclined ice ramp. The baffle slopes downwardly from a rear end of the ice bin cavity to support a portion of the ice and thereby reduce a load exerted by the ice on the helical auger.

BRIEF DESCRIPTION OF THE DRAWINGS

The present disclosure includes the following Figures. The same numbers are used throughout the Figures to reference like features and like components.

DETAILED DISCLOSURE

In the present description, certain terms have been used for brevity, clearness, and understanding. No unnecessary limitations are to be inferred therefrom beyond the requirement of the prior art because such terms are used for descriptive purposes only and are intended to be broadly construed.

The present disclosure generally relates to reduced footprint ice and beverage dispensing systems with easily accessible and serviceable dispensing augers. Current ice dispensing systems utilized in beverage machines often use square-shaped hoppers to store between 150 to 300 lbs of ice. A rotating agitator within the square-shaped hopper both causes the ice to be dispensed from the hopper and prevents bridging, that is, a condition in which the ice clumps together and becomes unusable. The present inventors have recognized that current ice dispensing systems have multiple disadvantages, including that the large capacity hoppers require a large footprint and that the rotating agitators do not work well with ice in nugget form, which is often preferred by consumers. An improved system with an easily serviceable wire auger that permits ice storage and dispensing of approximately 60 to 80 lbs of ice with minimal risks of bridging for all forms of ice would therefore be useful.

Figure 1:
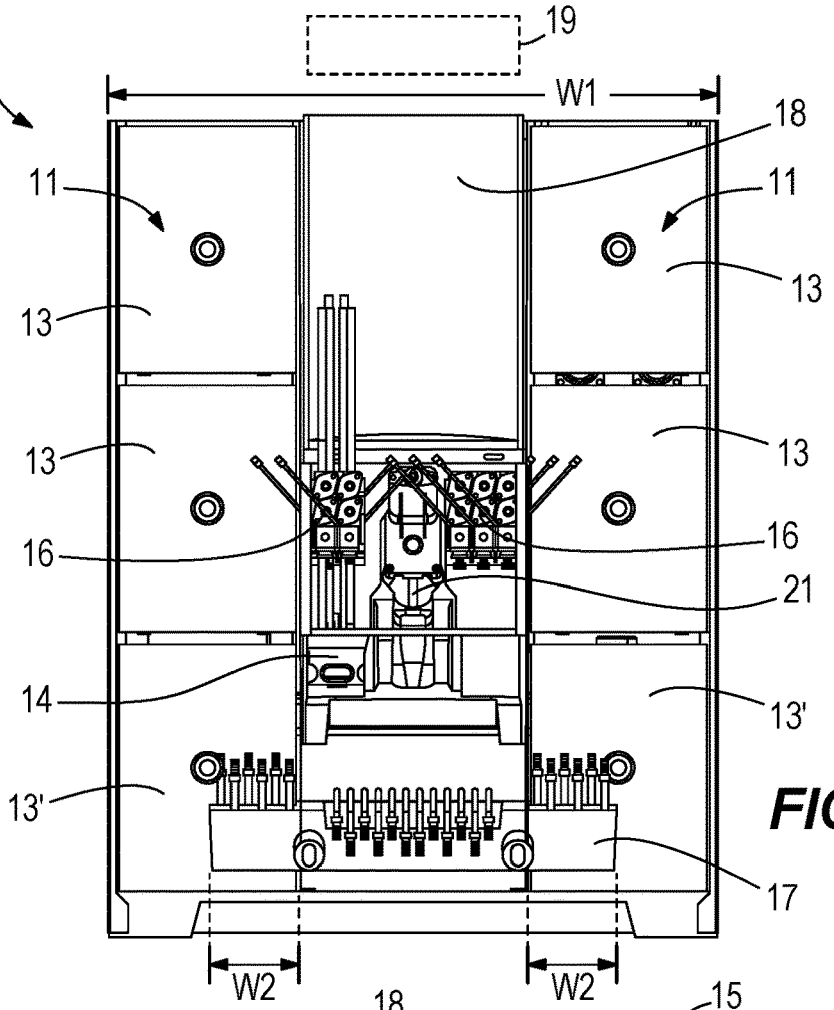
FIG. 1 is a front view of an example ice and beverage dispenser according to the present disclosure with a conventional cold plate assembly.
Figure 2:
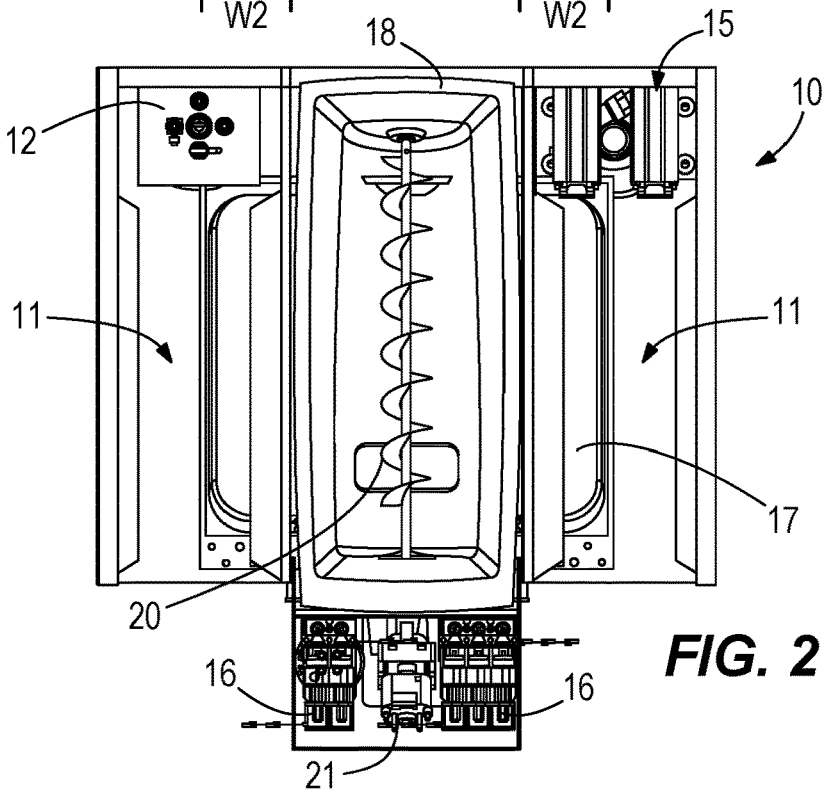
FIG. 2 is a top plan view of the ice and beverage dispenser of FIG. 1.

FIGS. 1-2 depict an example ice and beverage dispenser 10 of the present disclosure. The dispenser 10 dispenses mixed beverages, such as post-mixed sodas and juices, to an operator. The enclosure panels of the beverage dispenser 10 are excluded to expose the interior components of the dispenser 10.

The dispenser 10 is connected to beverage component sources, such as a carbonator 12 that dispenses carbonated water and bag-in-box containers 13 that dispense concentrate syrups. The carbonator 12 and the bag-in-box containers 13 are positioned in cavities 11 defined by the dispenser 10. A pump/motor assembly 15 is provided to pump certain beverage components through the dispenser 10. The beverage components are conveyed through piping (not shown) to different components of the dispenser 10 including a conventional cold plate 17 and valves 16.

The conventional cold plate 17 has a plurality of channels through which the beverage components are conveyed. Note that FIG. 1 depicts the conventional cold plate 17 overlapping and interfering with the bottom row of bag-in-box containers 13'. The cold plate 17 has an angled surface (not shown) on which melting ice and/or cold water from an ice hopper 18 contact. Accordingly, the angled surface is cooled by the melting ice and cold water, and thus, the beverage components in the cold plate 17 are cooled. The other surfaces of the cold plate 17 are covered with insulation, such as foam. Note that the insulation is excluded from FIGS. 1-2 for clarity. An ice maker 19 is optionally positioned above the ice hopper 18 and dispenses ice into the ice hopper 18. An auger 20 in the ice hopper 18 agitates the ice and dispenses the ice through an ice chute (not shown) to the operator. The auger 20 is operated by a motor 21.

After the beverage components are cooled in the cold plate 17, the beverage components are further conveyed to valves 16 that receive the beverage components and selectively dispense one or more beverage components to a nozzle 14. Accordingly, the beverage components mix in the nozzle 14 or a cup to form the mixed beverage selected by the operator.

The present inventors have endeavored to decrease the overall width (see W1 on FIG. 1) of the dispenser 10 such that the dispenser 10 can be located in restaurants with limited countertop space. Through research and experimentation, the present inventors have recognized that when the width of the dispenser 10 is decreased, the conventional cold plate 17 disadvantageously extends into the cavities 11 that normally house bag-in-box containers 13. Note that distance W2 on FIG. 1 depicts the cold plate 17 extending into the cavities 11 occupied by the bottom row of bag-in-box containers 13'; thus, the bottom row of bag-in-box containers 13' would not fit in the dispenser 10. Accordingly, the dispensers 10 with decreased width and conventional cold plates 17 house less bag-in-box containers 13 than wider dispensers 10. Furthermore, the present inventors have recognized that decreasing the size of conventional cold plates 17 reduces the surface area on which the melting ice and cold water contact. Accordingly, smaller versions of conventional cold plates may not sufficiently cool the beverage components. As such, the present inventors have endeavored to develop improvements to the dispenser 10 and new cold plates assemblies (described herein below) that overcome the problems noted above.

Figure 3:
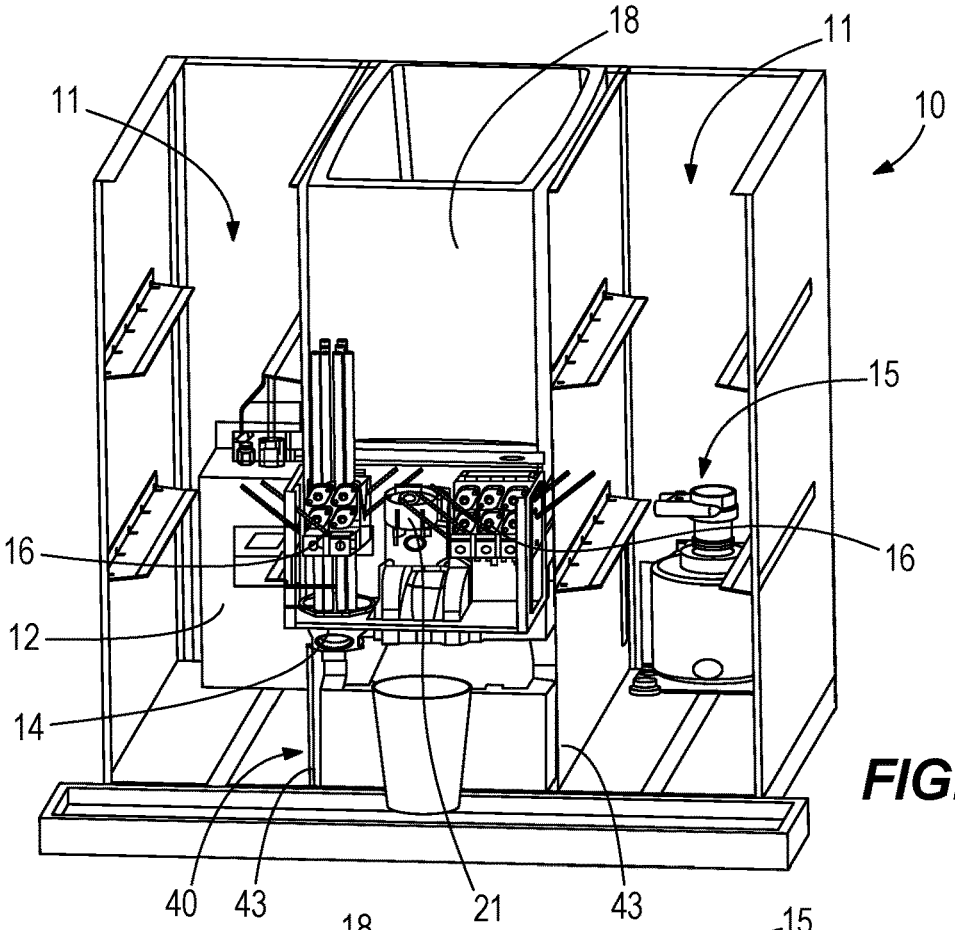
FIG. 3 is a perspective view of another example ice and beverage dispenser according to the example disclosure with an improved cold plate assembly.
Figure 4:
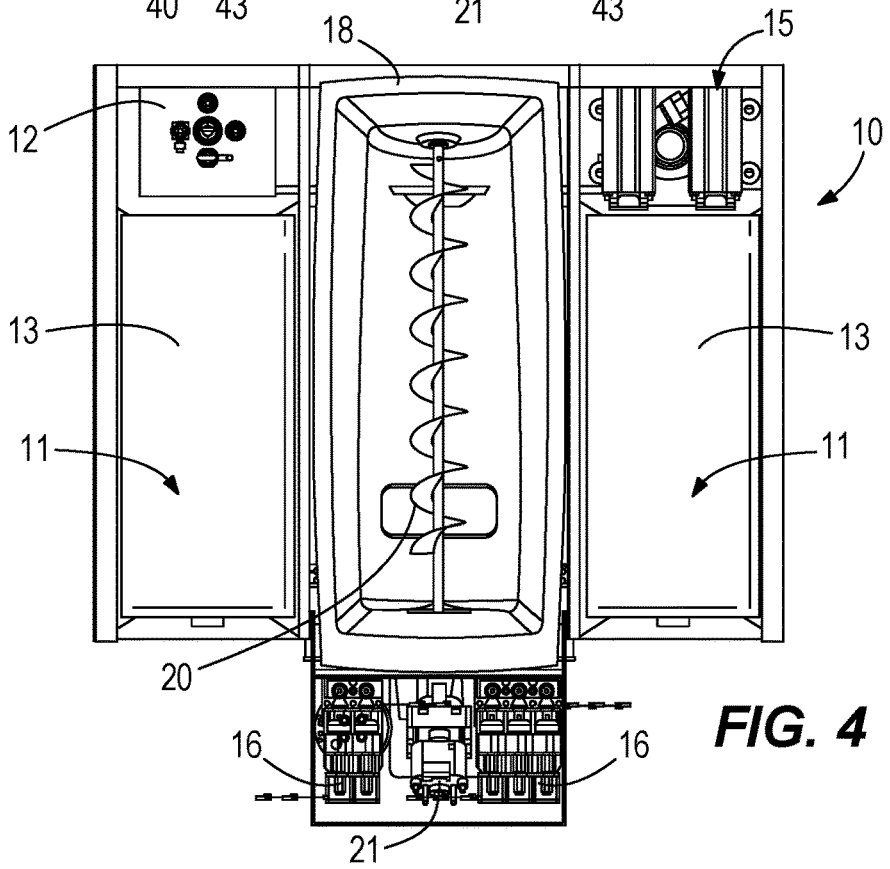
FIG. 4 is a top plan view of the ice and beverage dispenser of FIG. 3.
Figure 5:
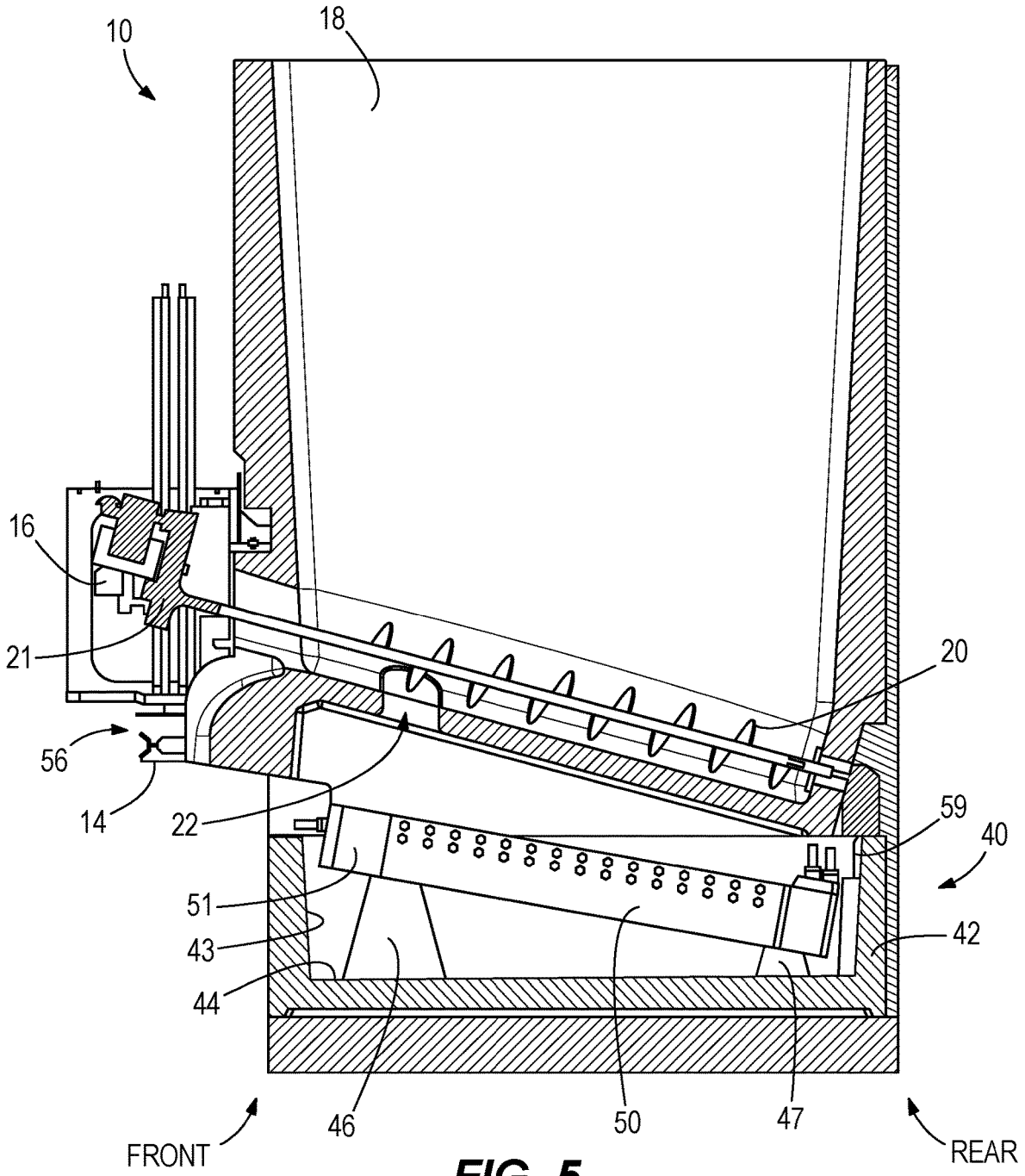
FIG. 5 is a side cross-sectional view of the ice and beverage dispenser of FIG. 3.

FIGS. 3-5 depict another example ice and beverage dispenser 10 according to the present disclosure. The dispenser 10 has a cold plate assembly 40 that is sized to fit within the dispenser 10 and not extend into the cavities 11. In the examples depicted in FIGS. 3-5, the cold plate assembly 40 is sized to correspond with the width of the ice hopper 18. Referring specifically to FIG. 5, the ice hopper 18 has one or more holes 22 through which melting ice and cold water passes into the cold plate assembly 40. The auger 20 is positioned at the bottom of the ice hopper 18 and is downwardly sloped or angled from the front to the rear of the dispenser 10. The auger 20 agitates the ice in the ice hopper 18 and moves melting ice and cold water to the hole 22. In an exemplary implementation, rotation of the auger 20 in a first direction moves ice toward an outlet 56 of the ice hopper 18 and rotation of the auger 20 in a second direction moves ice toward the holes 22.

The cold plate assembly 40 is shown to include a tank 42 positioned directly vertically below the ice hopper 18. The tank 42 receives and contains melting ice and cold water that passes through the hole 22. The tank 42 has sidewalls 43 that extend away from a base surface 44. A pair of pedestals 45, 46 extend from the base surface 44 in a vertical direction and are configured to support a cold plate 50 such that the top, bottom, and side surfaces of the cold plate 50 are spaced apart from the sidewalls 43 and/or the base surface 44. Furthermore, the heights of the pedestals 46, 47 differ such that the cold plate 50 is downwardly sloped from the front to the rear of the dispenser 10.

The cold plate 50 includes multiple channels through which the beverage components are conveyed. The cold plate 50 does not include insulation and thereby the top, bottom, and side surfaces of the cold plate 50 are exposed such that melting ice and cold water falling through the holes 22 contact the top surface of the cold plate 50. The melting ice and cold water flows due to gravity over the top surface of the cold plate 50 and into the tank 42. In certain implementations, the cold plate 50 has holes or openings 51 through which the melting ice and cold water pass into the tank 42. The melting ice and cold water collect in the tank 42 such that the bottom surface and the side surfaces of the cold plate 50 are in contact with (e.g., submerged in) the melting ice and cold water in the tank 42. Accordingly, multiple surfaces of the cold plate 50 are cooled. In comparison to conventional cold plates, the cold plate 50 depicted in FIG. 6 has a larger surface area that is cooled by the melting ice and cold water than the surface area cooled in conventional cold plate applications. Due to the increased amount of surface area cooled by the melting ice and cold water in the tank 42, the cold plate 50 depicted in FIG. 6 can be smaller than the conventional cold plates while still sufficiently cooling the beverage components. A drain hole 59 is positioned at a high water level of the tank 42 such that excess water drains from the tank 42. In other examples, the cold plate 50 is suspended above the base surface 44 by members that extends inwardly from the sidewalls 43.

In some implementations, the ice maker 19, the ice hopper 18, and the cold plate assembly 40 are modular and stackable. Accordingly, the components can be easily replaced and assembled. In further implementations, the cold plate 50 is angled such that the outlets of the cold plate 50, through which the beverage components dispense to the valves 16, are positioned near the valves 16. By contrast, the outlets of conventional cold plates are often angled away from the valves 16. As such, the distance between conventional cold plates and the valves 16 is greater than the distance between the valves 16 and the cold plate 50 of the present disclosure. Positioning the outlets near the valves 16 reduces the distance between the cold plate 50 and valves 16 and thereby increases beverage temperature performance.

Figure 6:
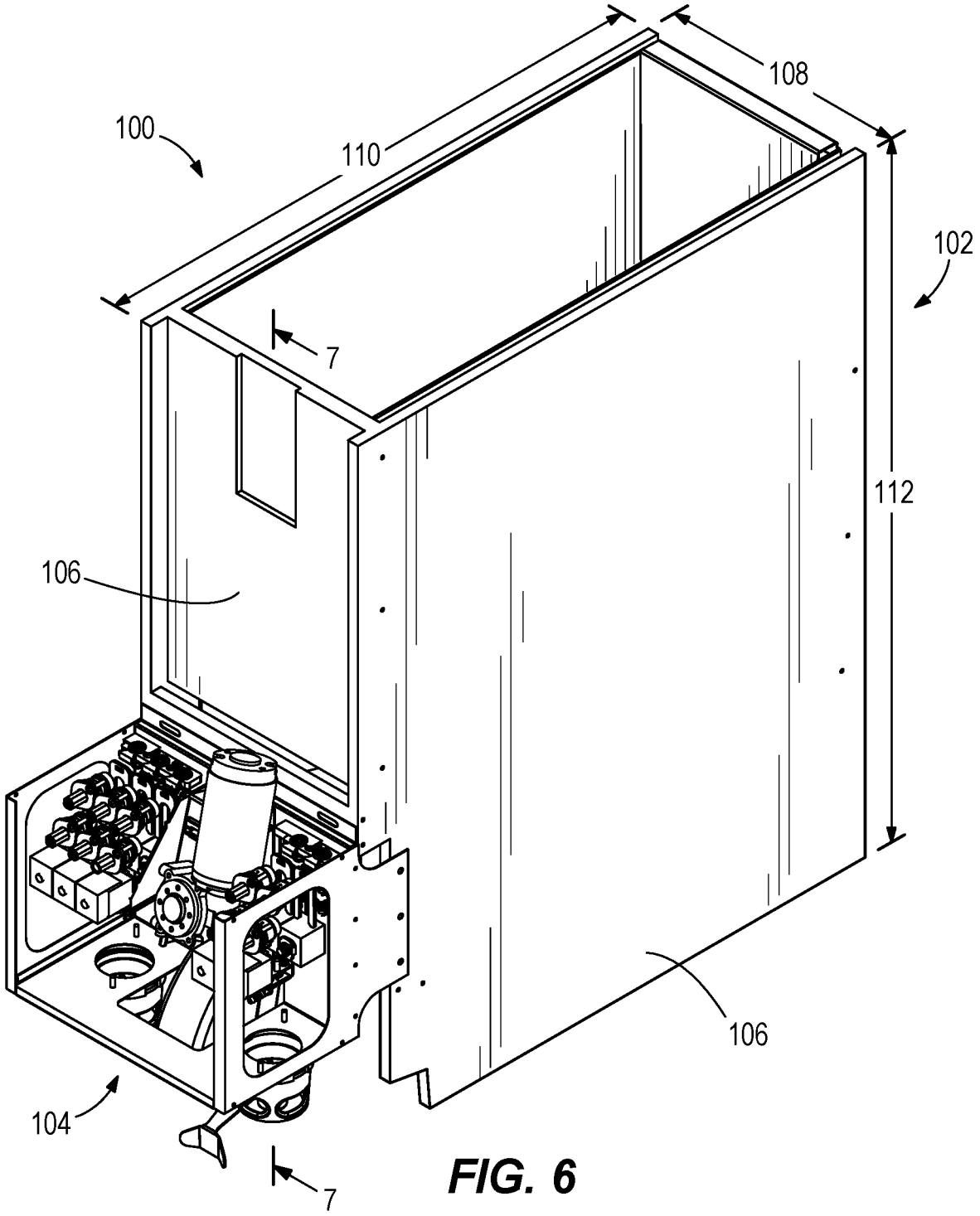
FIG. 6 is a perspective view of an example ice dispenser system with a vertical hopper according to the present disclosure.
Figure 7:
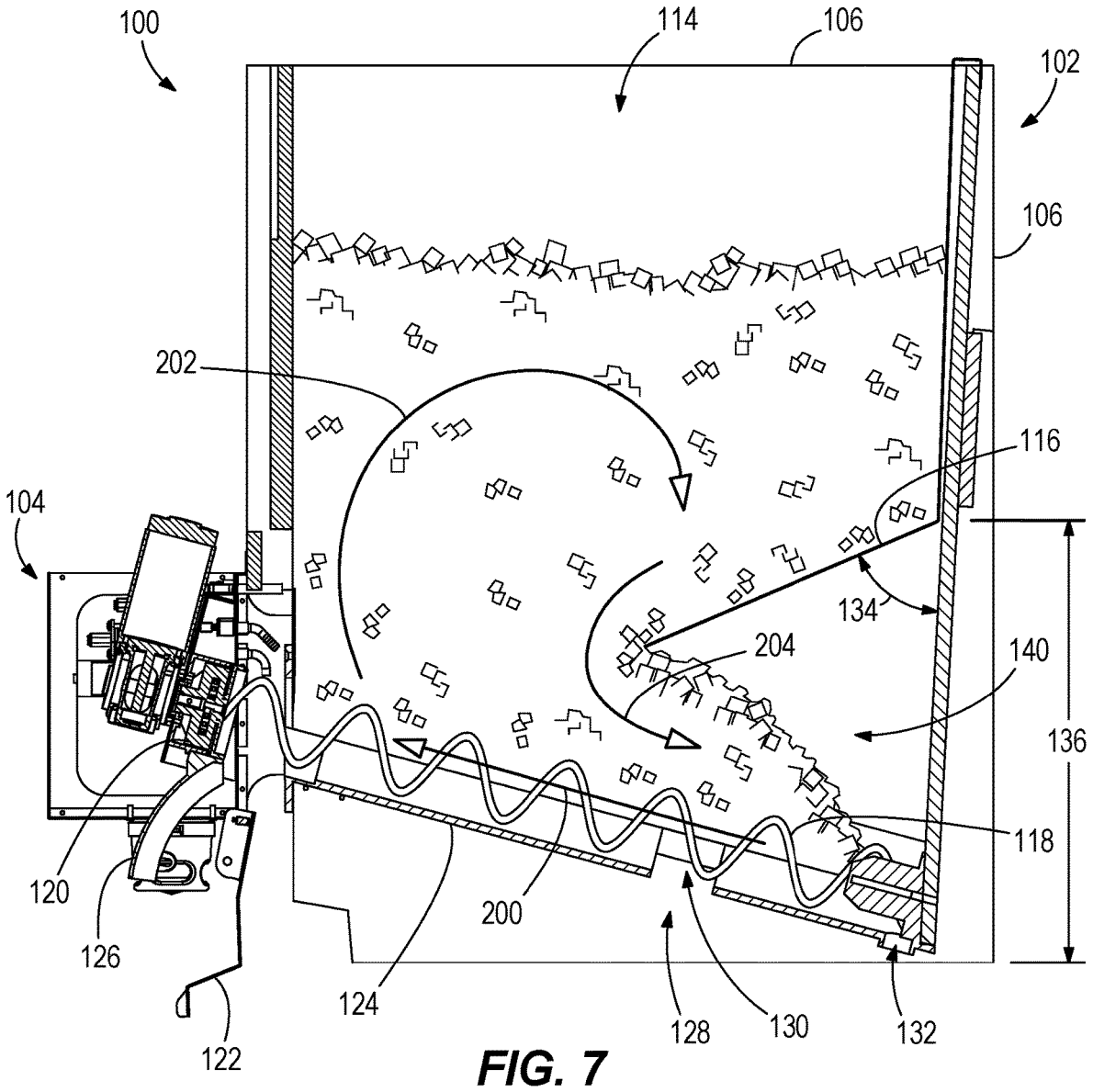
FIG. 7 is a side cross-sectional view of the ice dispenser system taken along the line 7-7 of FIG. 6.
Figure 8:
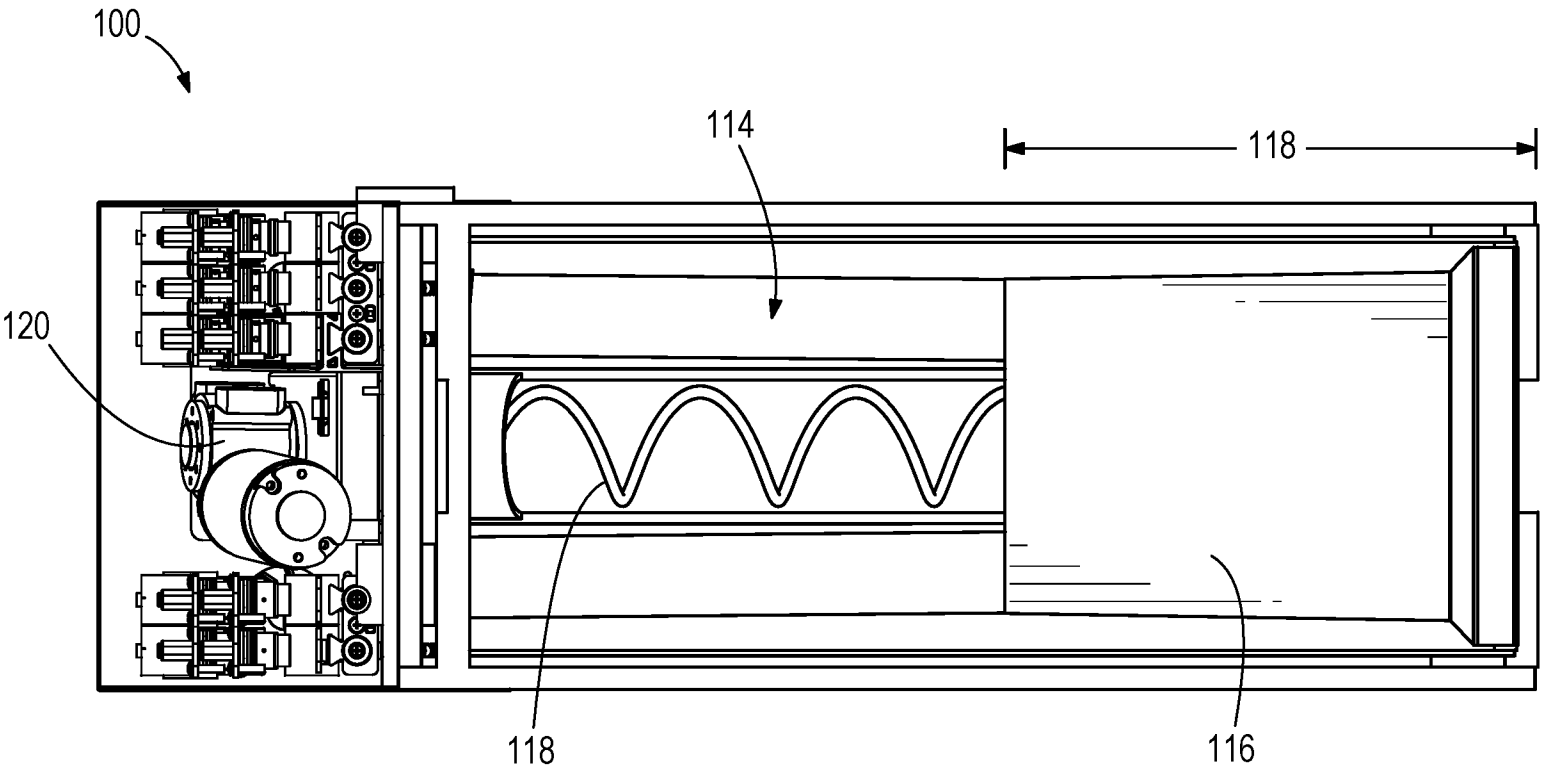
FIG. 8 is a top cross-sectional view of the ice dispenser system of FIG. 6.

Referring now to FIGS. 6-8, another exemplary ice dispensing system 100 is depicted. The ice dispensing system 100 is shown to include an ice bin structure 102 and a dispensing mechanism 104. The ice bin structure 102 includes a plurality of sidewalls 106 that form a substantially rectangular shape. In contrast to existing ice dispensing systems, the ice bin structure 102 has a narrow space-saving profile. For example, in an exemplary implementation, the width 108 of the ice bin structure 102 is approximately (i.e., ±10%) 15 inches, the depth 110 is approximately 22 inches, and the height 112 is a maximum of 30 inches. Although existing ice dispensing systems generally have a footprint in which the ratio of length to width is approximately 1:1, the ice bin structure 102 disclosed herein could have a ratio between the length or depth 110 and the width 108 of 1.5:1, 2:1, or 3:1.

As depicted in the cross-sectional views of FIGS. 7 and 8, the sidewalls 106 encapsulate a bin cavity 114. In some implementations, a liner may be situated inside the sidewalls 106 to directly contact the ice located within the bin cavity 114. In an exemplary implementation, premade ice in cube, crescent, or nugget form can be loaded into the bin cavity 114 manually by a user. In other implementations, an automatic ice maker device (e.g., ice maker 19) may be mounted within the ice bin structure 102 to deposit ice into the ice bin cavity 114.

A baffle 116 comprising a substantially plate-like member is shown to be attached to a rear sidewall 106 and positioned vertically midway within the ice bin cavity 114. The presence of the baffle 116 ensures the smooth operation of the ice dispensing system 100 by protecting a wire auger 118 situated below the baffle 116. The wire auger 118 operates to drive ice stored within the bin cavity 114 out of the ice bin structure 102 through a dispensing chute 126, as described in further detail below. The baffle 116 protects the auger 118 by supporting some of the ice within cavity 114 that would otherwise exert a direct load upon the auger 118, potentially leading to a stall condition. The baffle 116 further protects the auger 118 by sloping downwardly from the rear end to the front end of the ice bin cavity 114 and defining a pocket region 140 (depicted in FIG. 7) at the bottom of the cavity 114 that provides a space for the ice to flow as the auger 118 rotates, thus preventing an overload condition.

The characteristics of the baffle 116 are selected to enable the baffle 116 to perform the protective functions preventing stall detailed above, thus ensuring a good flow of ice to the auger 118 without resulting in bridging conditions. For example, the angle 134 and the height 136 of the baffle 116, both depicted in FIG. 7, may be approximately 17 degrees and 15 inches respectively. The length 138 of the baffle 116 depicted in FIG. 8 may be approximately 14 inches.

The wire auger 118 is shown to be positioned at the bottom of the ice bin structure 102 atop an inclined ice ramp 124. The wire auger 118 is preferably helically constructed and coupled to a motor 120 located within the dispensing mechanism 104. In some implementations, the motor 120 has a 38:1 ratio to optimize the flow rate of the ice as compared with the load induced on the motor 120 due to excessive torque caused by the ice load. In other implementations, the motor 120 may have a 50:1 or 75:1 ratio to optimize the flow rate of the ice. Operation of the motor 120 causes the auger 118 to rotate in a first direction and drive ice up the ramp 124 toward the dispensing chute 126. The incline of the ramp 124, that is, the angle between the ramp 124 and a horizontal plane, may be selected based on space and other geometrical constraints, and may range from 5 to 35 degrees.

The operation of the motor 120 may be controlled through a control device (not shown) located within the dispensing mechanism 104. When a user wishes to dispense ice from the ice dispensing system 100, the user positions a cup or other container below the dispensing chute 126 and moves a dispensing lever 122 rearward, that is, toward the baffle 116. Movement of the dispensing lever 122 causes the control device within the dispensing mechanism 104 to operate the motor 120 and rotate the auger 118 in the first direction, driving the ice up the ice ramp 124 and through the dispensing chute 126 into the cup or container.

The auger 118 may also be operated in a second direction that is opposite (i.e., the reverse) of the first direction used to drive the ice up the ice ramp 124. Operation in the second direction may be useful to break up blockages if ice bridging occurs. Ice bridging or clumping may jam the auger 118 and prevent the free travel of ice up the ice ramp 124 and out through the dispensing chute 126. To combat this condition, the control device may operate the motor 120 in the second direction upon detection of a high current condition indicating a higher than expected load on the motor 120 caused by a blockage. The control device may additionally operate the motor 120 in the second direction to prevent blockages according to an agitation schedule. For example, the agitation schedule may include operation of the motor in the second direction every 1-2 hours during an overnight period because an extended period of inactivity increases the risk of bridging and blockages.

In addition to detecting high current conditions, the control device for the motor 120 may also be configured to detect low current conditions representative of a lower than expected load on the motor 120. Lower than expected load conditions may occur when the ice level within the ice bin cavity 114 is low. In various implementations, the control device may be configured to operate a low ice indicator upon detection of the low current condition to inform a user that the ice within the ice bin cavity 114 must be replenished, or that the automatic ice maker mounted within the ice bin cavity 114 is in need of service or troubleshooting. In one example implementation, the low ice indicator could include a light mounted to the exterior of the ice dispensing system 100 that is illuminated by the control device when a low current condition is detected. In another example implementation, the low ice indicator could be a message displayed on a user interface mounted on or incorporated into the ice dispensing system 100.

Referring specifically to FIG. 7, in some implementations, a water bath region 128 is positioned below the ice ramp 124. The water bath region 128 may be utilized to cool beverage syrups or other liquids dispensed by valves located within the dispensing mechanism 104. The water bath region 128 may be supplied with ice loaded into the ice bin cavity 114. During operation of the auger 118, some portion of the ice driven up the ice ramp 124 passes through a water bath chute 130 and into the water bath region 128. In some implementations, depending on the size and requirements of the water bath region 128, more than one water bath chute 130 may be formed in the ice ramp 124. In addition to the water bath chute 130, an ice melt drain 132 may also be formed in the ice ramp 124 to supply melted water to the water bath region 128 or to otherwise remove melted water from the ice bin cavity 114. Unlike the chute 130, which may be dimensionally sized to permit the passage of solid ice, the drain 132 may be dimensionally smaller to permit only the passage of melted water rather than solid ice cubes.

Still referring to FIG. 7, upon traveling up the ice ramp 124 as indicated by the arrow 200 and reaching the dispensing chute 126, some portion of the ice travels through the dispensing chute 126 and exits the ice dispensing system 100, while another portion of ice is recirculated back towards the baffle 116, as indicated by the arrow 202. The recirculated portion of ice is joined with ice supported by the baffle 116, and collectively travels toward the pocket region 140 as indicated by the arrow 204. As shown, the baffle 116 ensures that the pocket region 140 remains free of ice to minimize the load exerted by the ice on the auger 118 and to prevent stall conditions.

Figure 9:
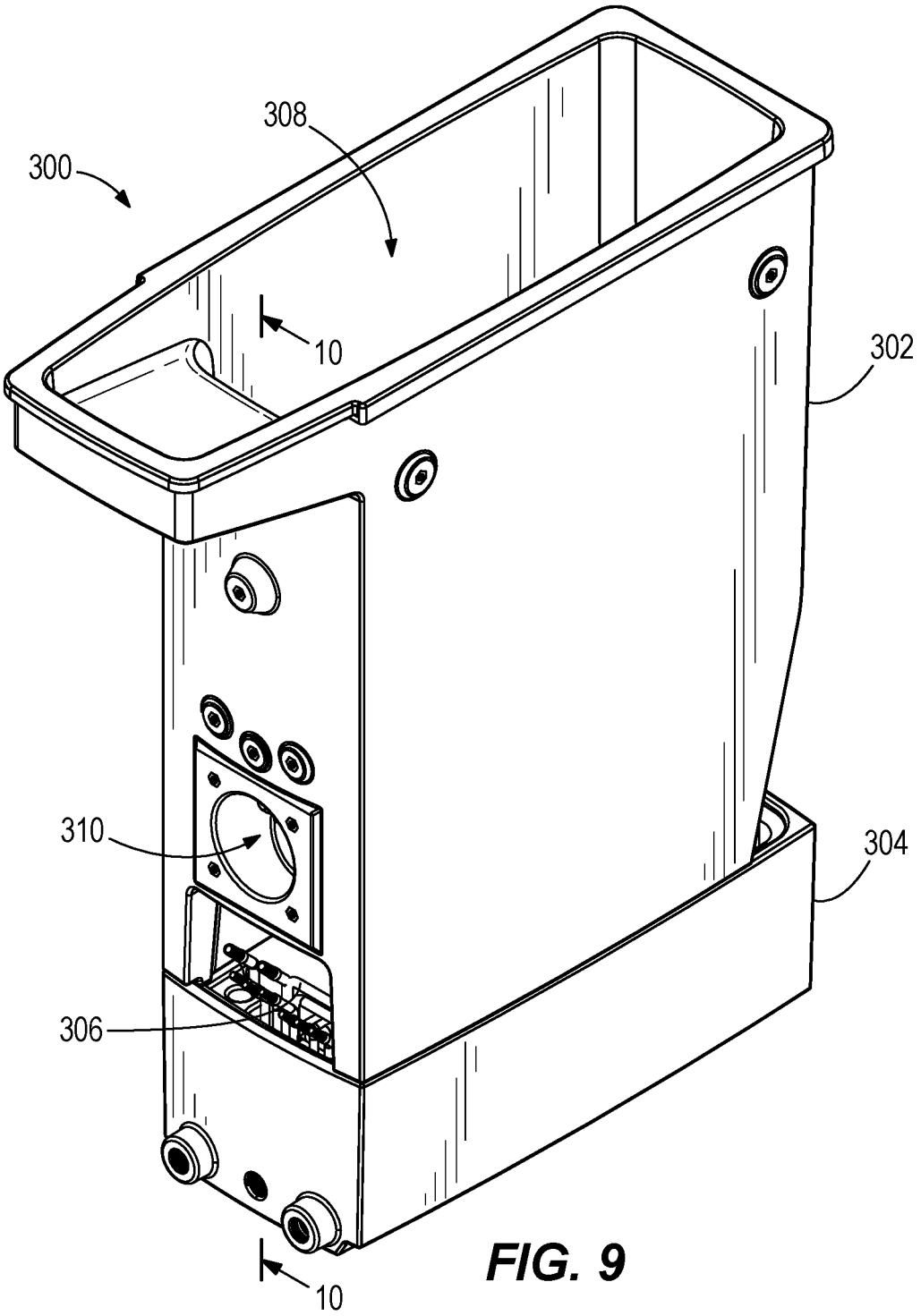
FIG. 9 is a perspective view of an alternate ice hopper structure according to the present disclosure.
Figure 10:
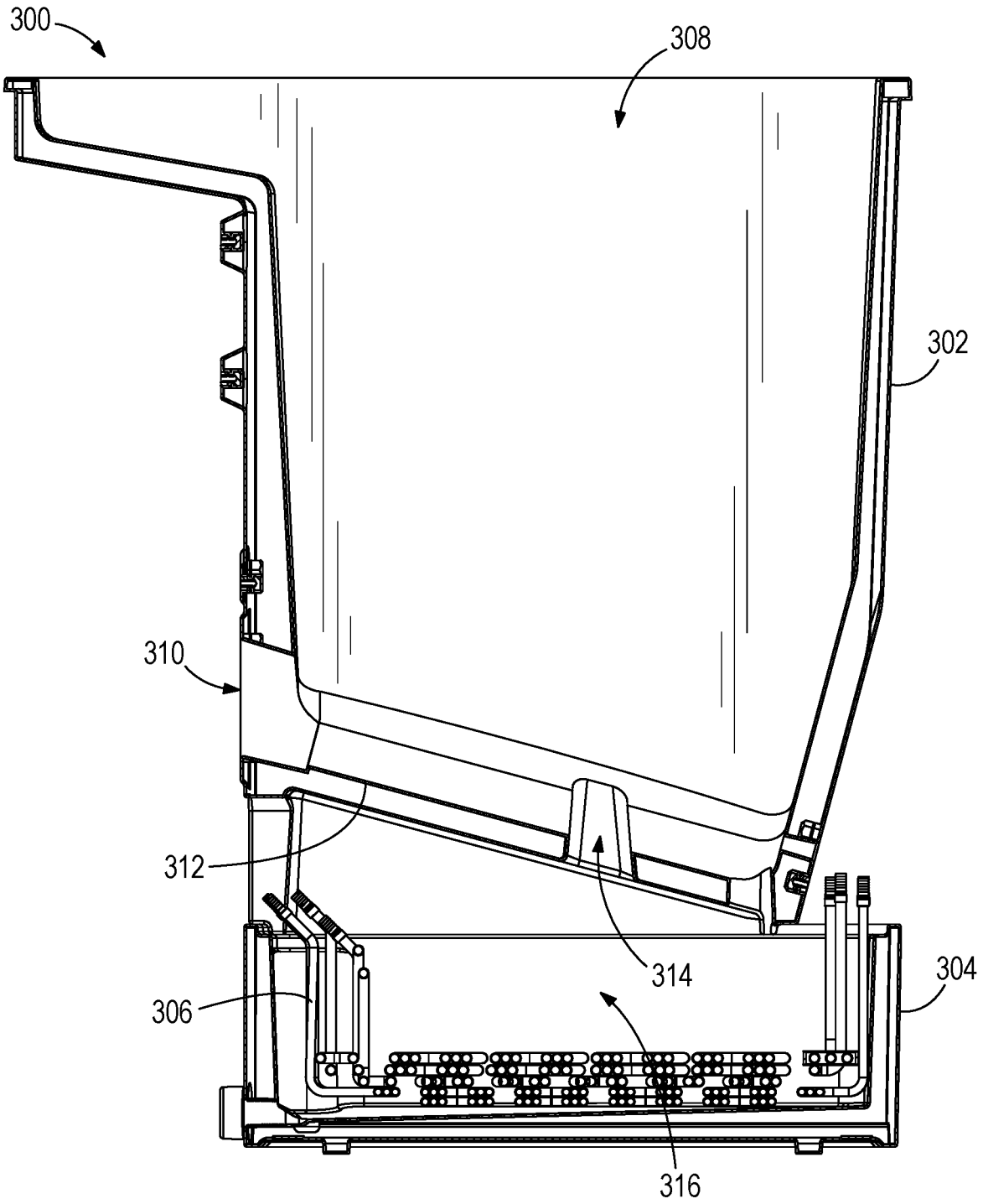
FIG. 10 is a side cross-sectional view of the ice hopper structure taken along the line 10-10 of FIG. 9.

Turning now to FIGS. 9 and 10, perspective and side-cross-sectional views of an alternative ice hopper bin structure 300 are depicted, according to an exemplary embodiment. The ice hopper bin structure 300 is shown to include an ice bin structure 302 situated above a water bath or cold plate structure 304. In some implementations, the cold plate structure 304 is identical or substantially similar to the cold plate assembly 40 described above with reference to FIG. 5. The water bath structure 304 includes a water bath region 316 that cools beverage lines 306 that extend through the water bath structure 304 and are coupled to a dispensing mechanism (not shown).

Ice is supplied into an ice bin cavity 308 either manually or through an automatic ice maker mounted in the ice bin structure 302. An auger (not shown) mounted using auger mounting hole 310 and situated above an ice ramp 312 drives a first portion of the ice up the ice ramp 312 and out of the bin structure 300 using a dispensing mechanism (e.g., a dispensing chute similar to dispensing chute 126, depicted in FIGS. 6 and 7). A second portion of the ice is driven through the water bath chute 314 and into the water bath region 316. As described above, in some implementations, the auger may be operated in a second, or reverse, direction than the first direction used to drive the ice up the ice ramp 312. In addition to preventing blockages that would otherwise jam the auger, operating the auger in the second direction deposits ice through the water bath chute 314 and into the water bath region 316 to ensure that the water bath region 316 is kept sufficiently cool. For example, the auger may be automatically operated in the reverse direction upon the expiration of a configurable period (e.g., 1 or 2 hours) from the last actuation of the dispensing mechanism.

Figure 11:
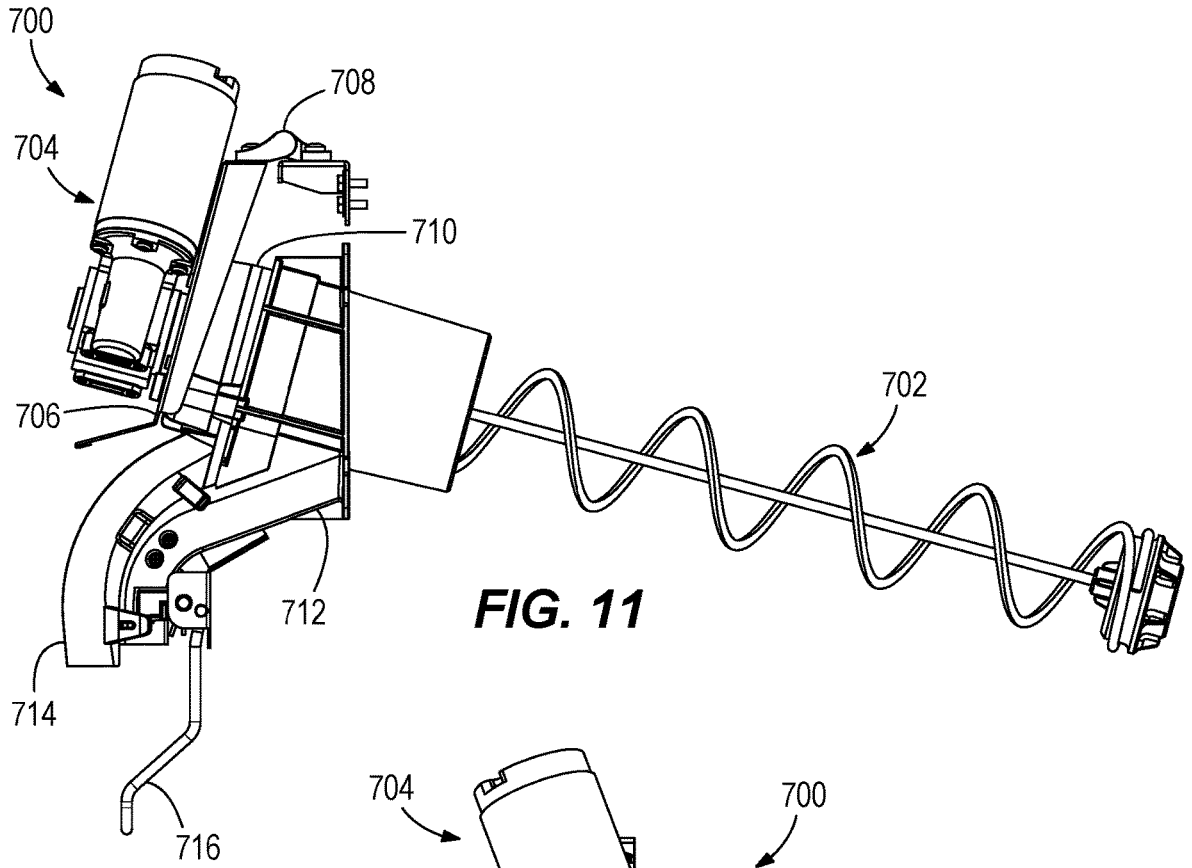
FIG. 11 is a side view of an auger drive assembly that can be utilized in the ice dispenser system of FIG. 6.
Figure 12:
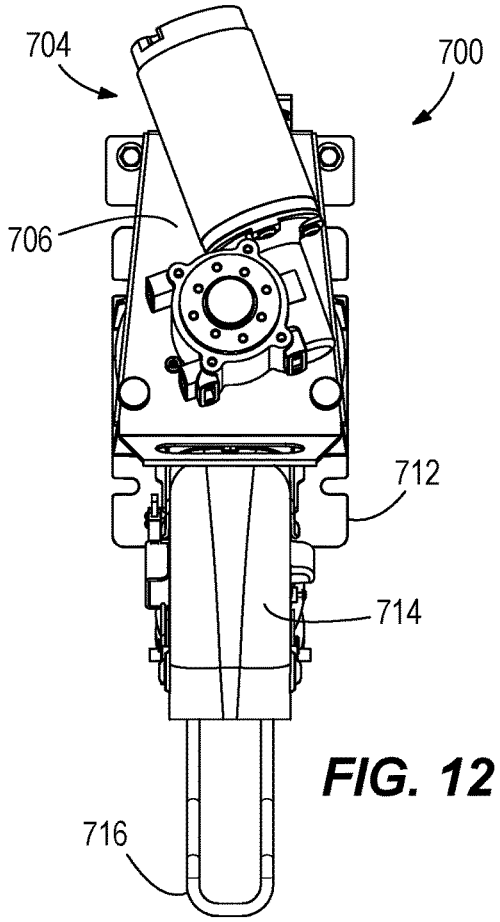
FIG. 12 is a front view of the auger drive assembly of FIG. 11.

Referring now to FIGS. 11 and 12, side and front views of an auger drive assembly 700 are depicted, according to an exemplary embodiment. In some implementations, the auger drive assembly 700 may be utilized in the ice and beverage dispenser structures depicted and described above with reference to FIGS. 1-10. The auger drive assembly 700 is shown to include an auger assembly 702 and a drive assembly 704. When coupled to an ice bin structure (e.g., ice bin structure 102, ice bin structure 302) the drive assembly 704 is configured to rotate the auger assembly 702 to drive ice up a sloped surface of the ice bin structure and through an ice chute 712.

The drive assembly 704 is shown to be coupled to a drive mounting plate 706. The drive mounting plate 706 is movable between a closed position that is utilized when the ice dispenser is in operation and an opened position that is utilized to provide access to the auger assembly 702 for service or repair functions. (See FIGS. 24 and 25 for depictions of the drive mounting plate 706 in the opened position.) Drive plate hinge 708 is shown to be coupled to the drive mounting plate 706 to permit rotation of the drive mounting plate 706 and the drive assembly 704. In an exemplary implementation, drive plate hinge 708 is a friction hinge. In other implementations, a different type of hinge may be utilized, for example, a torsion spring hinge. Further details of the drive plate hinge 708 are included below with reference to FIGS. 20 and 21. In still further implementations, rather than pivoting, the drive mounting plate 706 moves in a translating, sliding, or telescoping fashion to provide access to the auger assembly 702.

An ice chute interface 710 is shown to be positioned between the drive mounting plate 706 and the ice chute 712. Gears utilized to transfer torque from the drive assembly 704 to the auger assembly 702 are mated within the ice chute interface 710. Further details are included below with reference to FIGS. 15-19. An ice chute cover 714 is shown to be coupled to the ice chute 712 to define the path of travel for ice dispensed from the ice bin structure. In some implementations, the ice chute cover 714 may be removable from the ice chute 712 for cleaning purposes. In further implementations, the ice chute cover 714 may be fabricated from a flexible material that reduces the noise of ice dispensing as compared with conventional dispensers with rigid ice chutes. An actuator lever 716 is also shown to be coupled to the ice chute 712. As described above, pivotal movement of the actuator lever 716, for example, rearward pivoting of the lever 716 towards the auger assembly 702 resulting from placement of a cup below the ice chute 712, causes a control device to operate the drive assembly 704 to drive rotation of the auger assembly 702 and cause ice to be dispensed through the ice chute 712.

Figure 13:
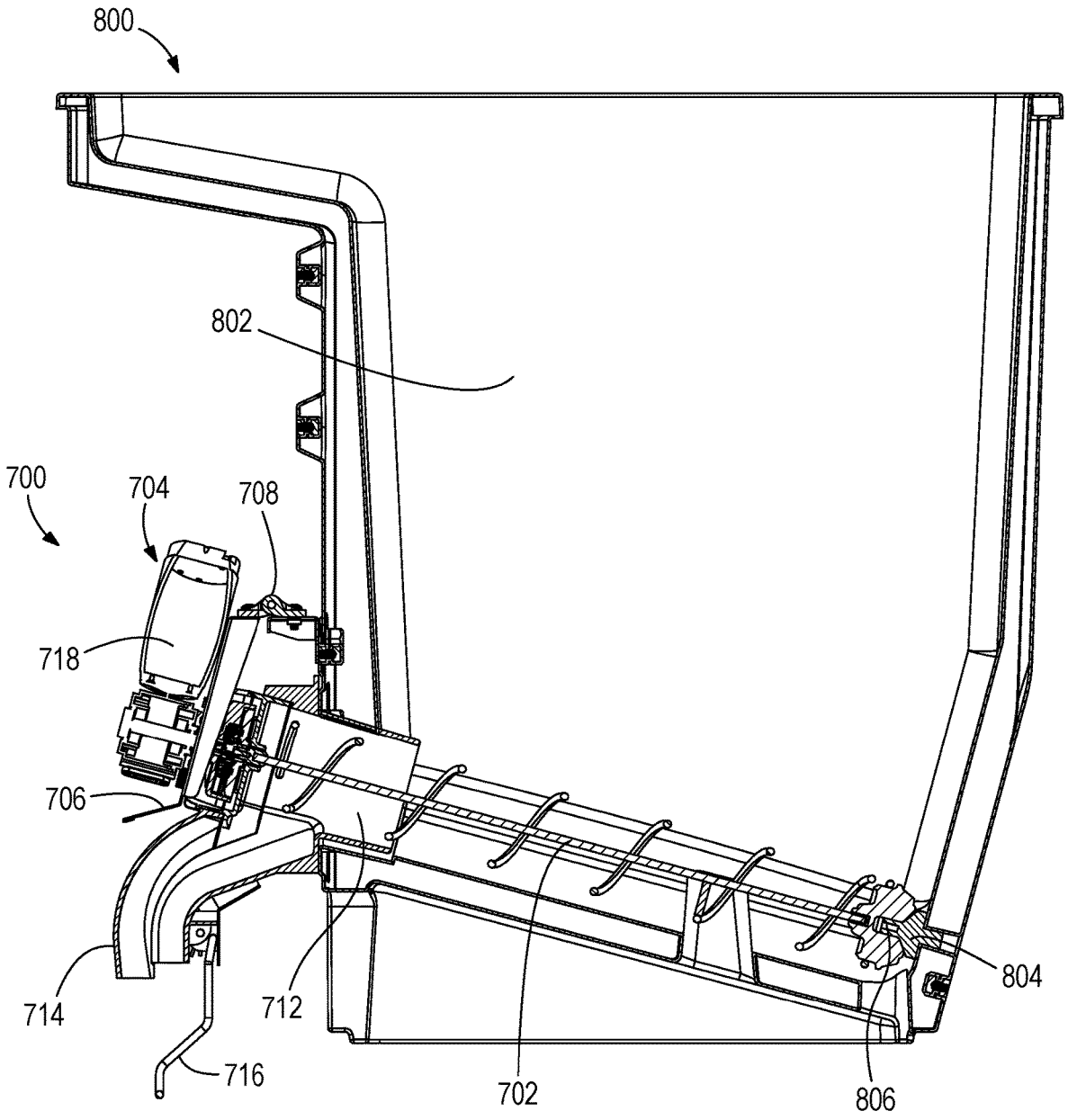
FIG. 13 is a side cross-sectional view of the ice dispenser system of FIG. 6.

As depicted in FIG. 13, ice dispenser 800 includes the auger drive assembly 700 coupled to an ice bin structure 802. In various implementations, the ice bin structure 802 is identical or substantially similar to the ice bin structure 102. For example, similar to the arrangement depicted in FIG. 7, the auger assembly 702 is mounted above a ramp structure formed within the ice bin structure 802. Movement of the actuator lever 716 starts an auger activation switch 728 that operates the motor 718 to rotate the auger assembly 702 and drive ice out through the ice chute 712.

A hopper bearing 804 is also shown to be mounted in the ice bin structure 802. The hopper bearing 804 may be coupled to the auger assembly 702 using a bearing pin 806 such that rotation of the auger assembly 702 driven by the drive assembly 704 results in rotation of the hopper bearing 804 and the bearing pin 806. In some implementations, the bearing pin 806 may include features (e.g., tapered surfaces) that ensure proper alignment of the auger assembly 702 relative to the hopper bearing 804 and the ice bin structure 802. The alignment features may be particularly important since the auger assembly 702 may be inserted into the ice bin structure 802 and blindly mated with the bearing pin 806 and the hopper bearing 804.

Figure 14:
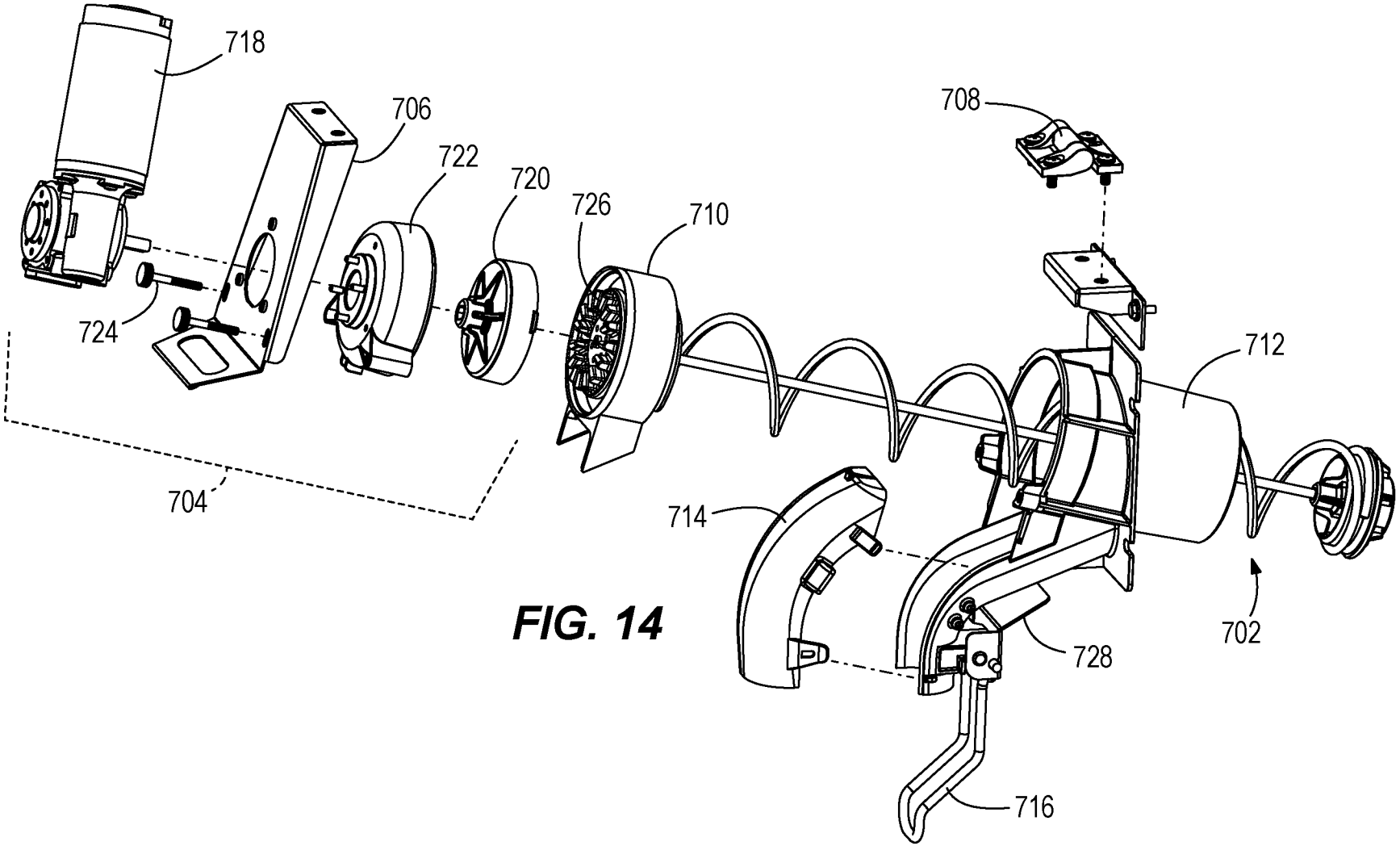
FIG. 14 is an exploded view of the auger drive assembly of FIG. 11.

Turning now to FIG. 14, an exploded view of the auger drive assembly 700 is shown. The drive assembly 704 includes a motor 718 coupled to the drive mounting plate 706. As described above, in some implementations, the motor 718 has a 38:1 ratio to optimize the flow rate of the ice. The motor 718 is operably coupled and configured to drive rotation of a drive gear 720 that is located within a clutch housing 722 on a rear side of the drive mounting plate 706 opposite the motor 718. The drive gear 720 is mated with a corresponding auger gear 726 (depicted in FIGS. 18 and 19), and rotation of the drive gear 720 driven by the motor 718 causes corresponding rotation of the auger gear 726 and the auger assembly 702.

The drive assembly 704 is further shown to include a drive assembly locking component 724. The drive assembly locking component 724 acts to retain the drive assembly 704 and the drive mounting plate 706 in a closed position and inhibits rotation of the drive mounting plate into the opened or servicing position. In various implementations, the locking component 724 may be a threaded or quarter-turn fastener that is received by a mating feature (e.g., a threaded hole) formed in the ice chute 712 or another structural component (e.g., a mounting bracket) of the ice dispenser 800.

Figure 15:
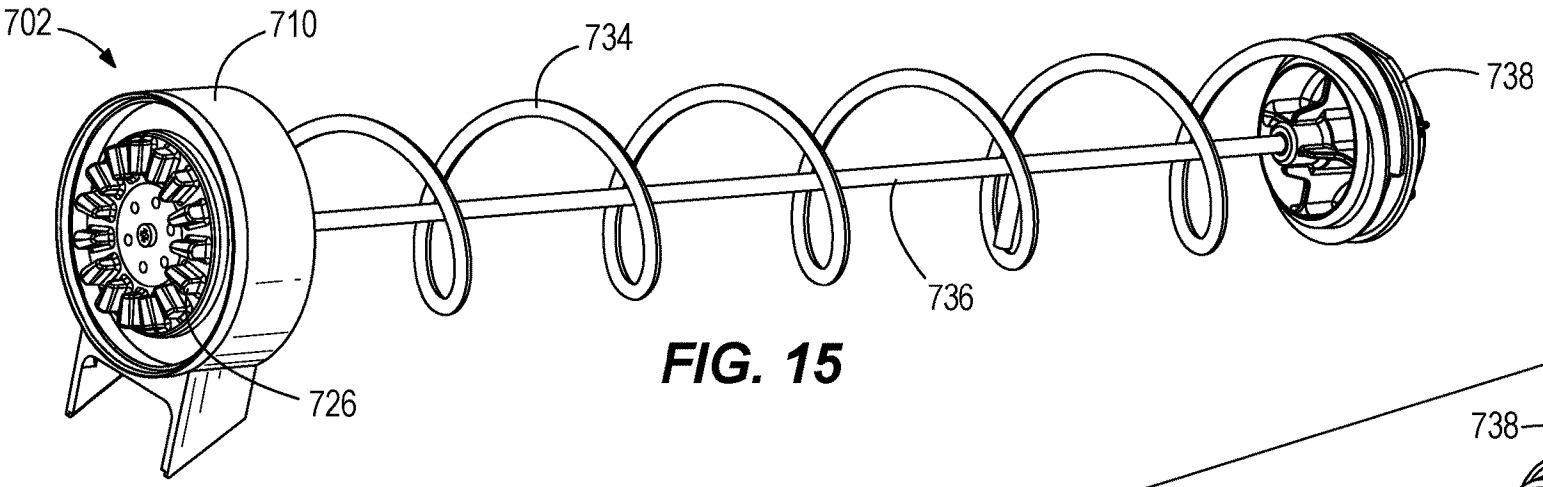
FIG. 15 is a perspective view of an auger assembly utilized in the auger drive assembly of FIG. 11.
Figure 16:
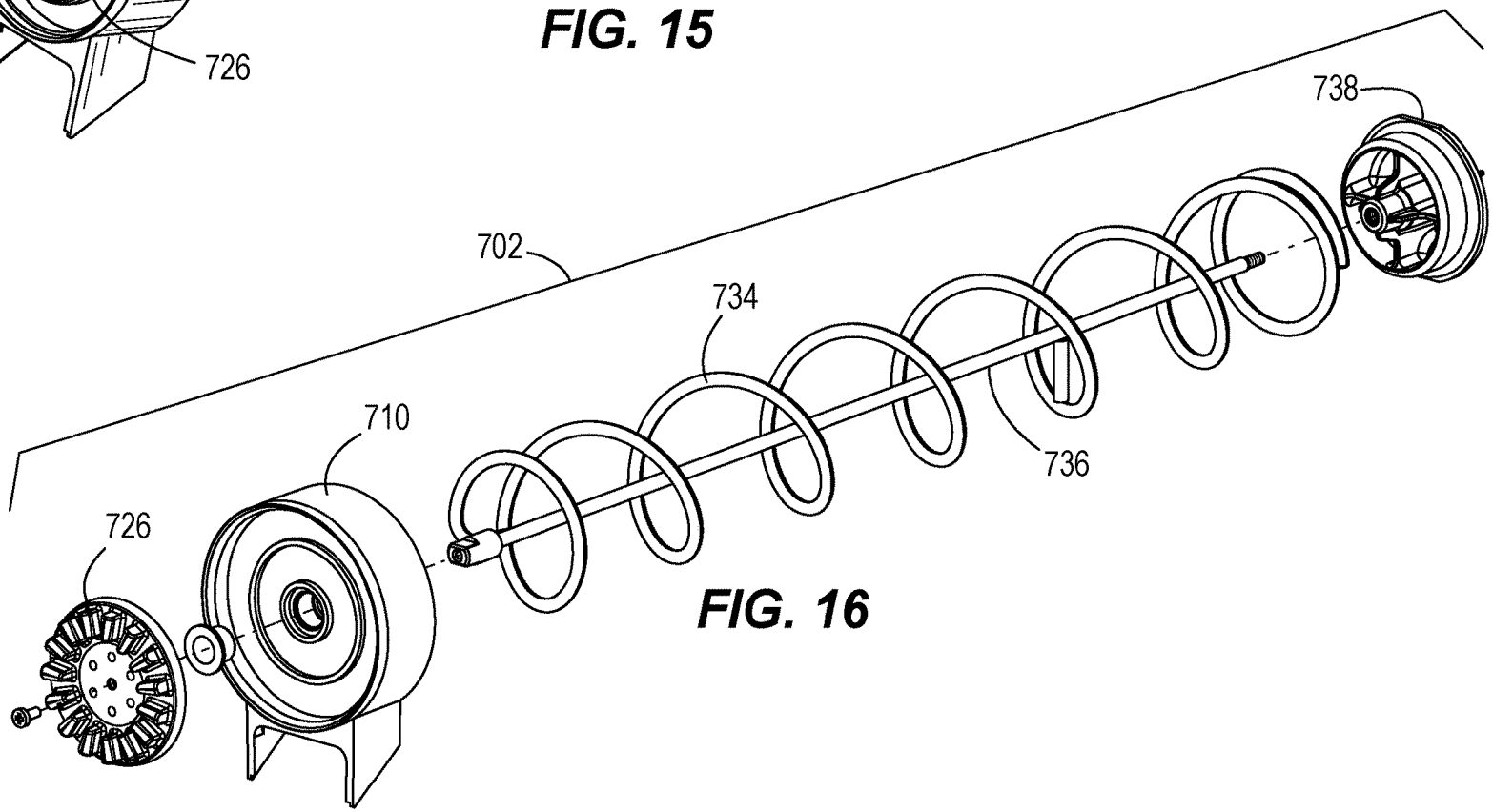
FIG. 16 is an exploded view of the auger assembly of FIG. 15.

FIGS. 15 and 16 respectively depict perspective and exploded views of the auger assembly 702. The auger assembly 702 is shown to include a helical wire auger 734 with a central tensioning rod 736. The central tensioning rod 736 may prevent the wire auger 734 from compression and disengagement from the bearing pin 806 and the hopper bearing 804. In some implementations, as depicted in FIG. 16, the helical wire auger 734 and the central tensioning rod 736 are formed as a single component. In other implementations, the auger 734 and the tensioning rod 736 are formed as separate components and later assembled. In contrast to solid augers, which have been found to jam and stall when utilized in similar ice dispensers, the wire auger as described herein has been found to efficiently drive ice up a ramp structure of an ice bin without resulting in bridging of ice that may cause the motor 718 to stall.

The ice chute interface component 710 and the auger gear 726 are shown to be positioned at a first end of the helical wire auger 734, and an auger bearing component 738 is shown to be positioned at a second end of the helical wire auger 734 that is opposite the first end. Advantageously, the ice chute component 710 at least partially encapsulates the auger gear 726 and forms a barrier between the mated drive gear 720 and auger gear 726 and the path of the ice driven by the auger 734. In this way, the dispensed ice is not contaminated by the gears 720, 726. The auger bearing component 738 is secured to and rotates with the helical wire auger 734 and the tensioning rod 736. The auger bearing component 738 also includes a receiving feature (e.g., a hole or recess) that enables the auger bearing component 738 to mate with the bearing pin 806, described above with reference to FIG. 13.

Figure 17:
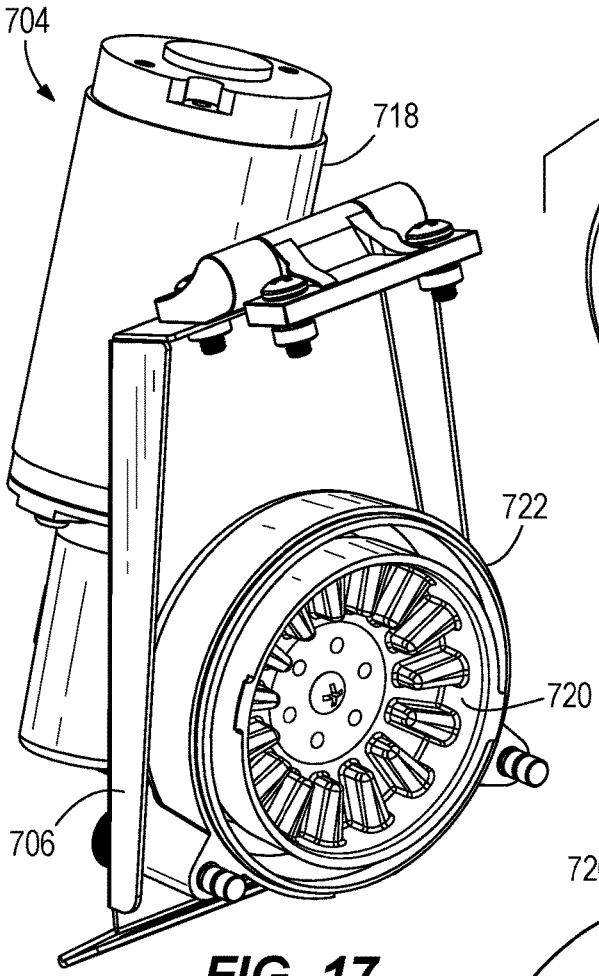
FIG. 17 is a perspective view of a drive assembly utilized in the auger drive assembly of FIG. 11.
Figure 18:
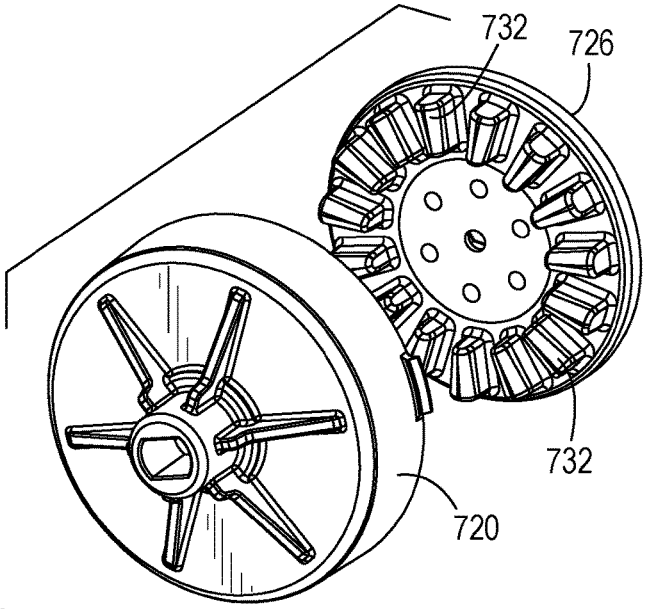
FIG. 18 is a perspective view of the coupling between an auger drive clutch and an auger clutch utilized in the auger drive assembly of FIG. 11.
Figure 19:
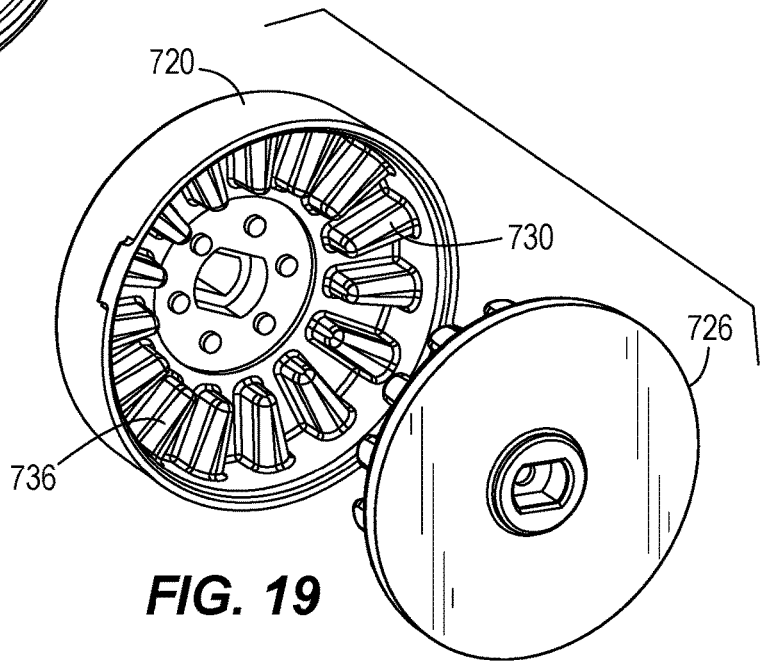
FIG. 19 is another perspective view of the coupling between an auger drive clutch and an auger clutch utilized in the auger drive assembly of FIG. 11.

FIGS. 17-19 depict the engaging features of the drive gear 720 and the auger gear 726. As shown, the drive gear 720 includes internal teeth 730 and the auger gear 726 includes external teeth 732. In other implementations, the drive gear 720 may include external teeth and the auger gear 726 may include internal teeth. When the drive assembly 704 and the drive mounting plate 706 are in the closed position, the external teeth 732 of the auger gear 726 are interdigitated with the internal teeth 730 of the drive gear 720. This arrangement is otherwise known as a dog clutch, and a clearance or interference fit between the external teeth 732 and the internal teeth 730 cause both the drive gear 720 and the auger gear 726 to rotate at the same speed without slip. Although FIGS. 18 and 19 depict each of the drive gear 720 and the auger gear 726 as including fifteen complementary teeth 730, 732, in other implementations, the drive gear 720 and the auger gear 726 may include any number of teeth 730, 732. Advantageously, the distributions of both the external teeth 732 and the internal teeth 730 may be radially symmetrical, such that the auger assembly 702 is not required to be precisely located relative to the drive assembly 704 with keying features in order to achieve successful registration between the drive gear 720 and the auger gear 726.

Figure 20:
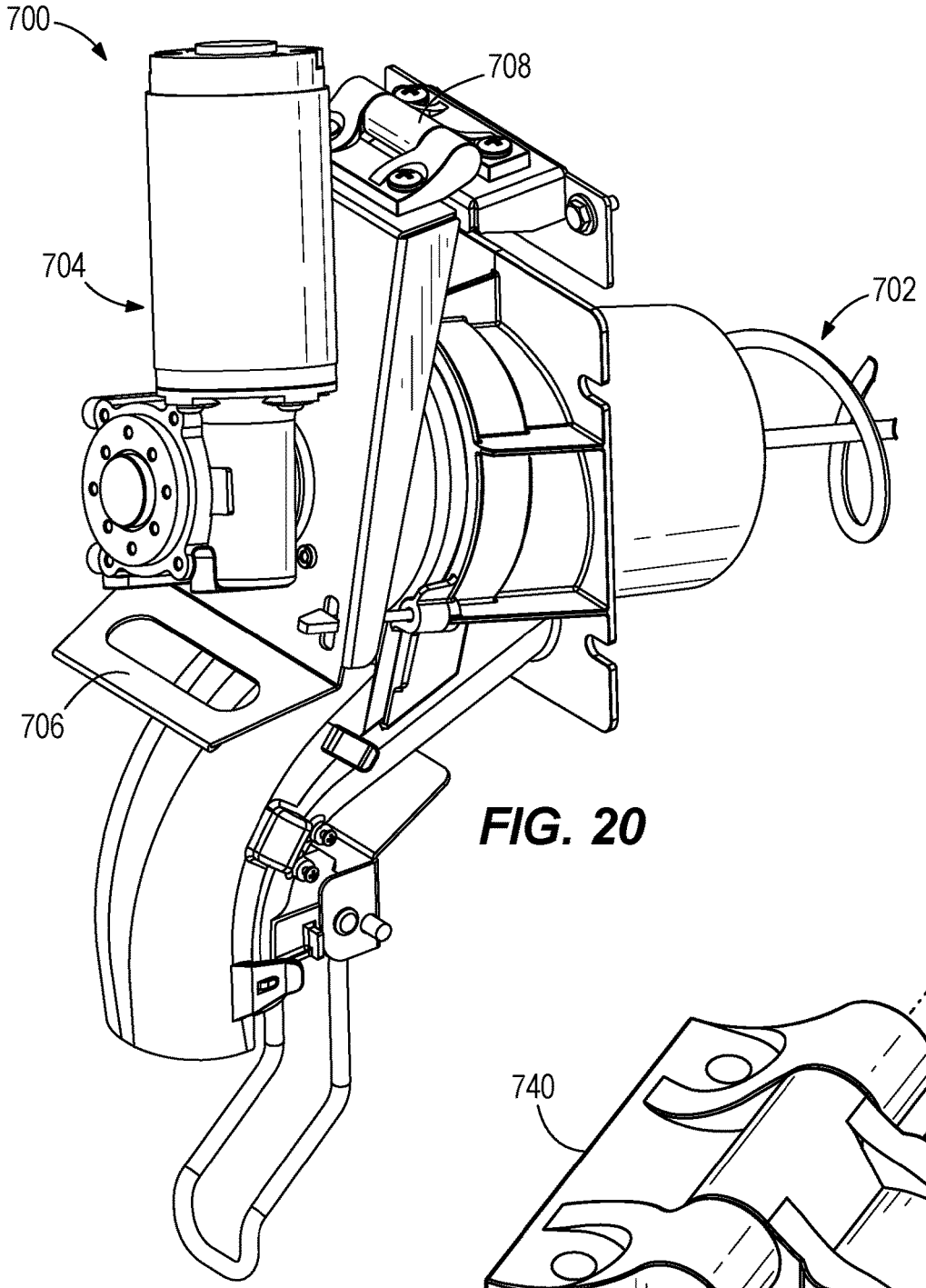
FIG. 20 is a perspective view of the auger drive assembly of FIG. 11 including a friction hinge assembly.
Figure 21:
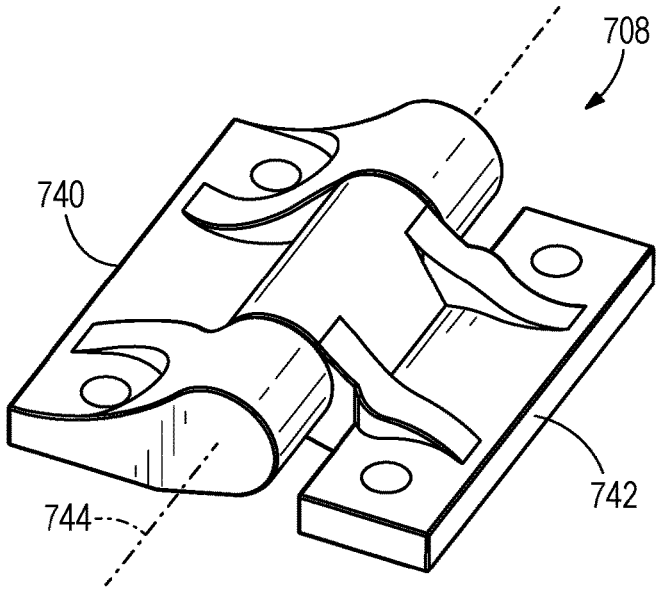
FIG. 21 is a perspective view of the friction hinge assembly of FIG. 20.

Turning now to FIGS. 20 and 21, the drive plate hinge 708 is depicted in greater detail. As described above, in an exemplary implementation, the drive plate hinge 708 is a gravity hinge. The gravity hinge, which may also be known as a self-function hinge, is shown to include a first hinge component 740 that is pivotably coupled to a second hinge component 742. The hinge components 740, 742 may pivot relative to each other along an axis 744 to permit the drive assembly 704 and the drive mounting plate 706 to rotate upwardly and expose the auger assembly 702. In contrast to a standard hinge, the gravity hinge utilizes the weight of the drive assembly 704 and the drive mounting plate 706 to slowly return to the closed position from the opened position, thereby preventing injury to a technician that could occur should the drive mounting plate 706 suddenly swing downwardly from the open position.

Figure 22:
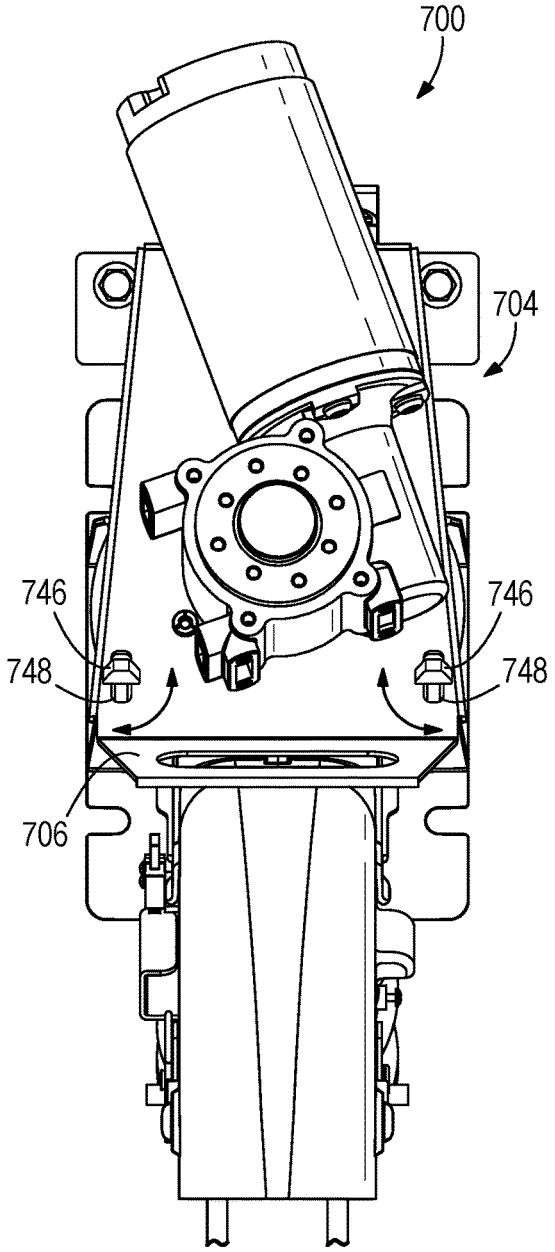
FIG. 22 is a front view of the auger drive assembly of FIG. 11 including twist threaded locks in a closed position.
Figure 23:
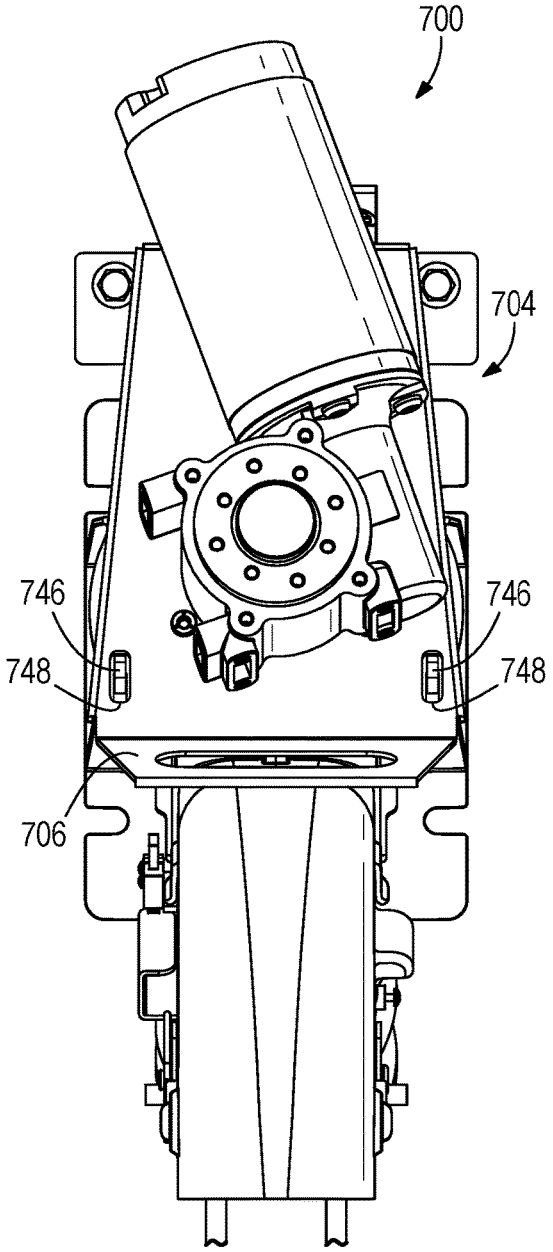
FIG. 23 is a front view of the auger drive assembly of FIG. 11 including twist threaded locks in an opened position.
Figure 24:
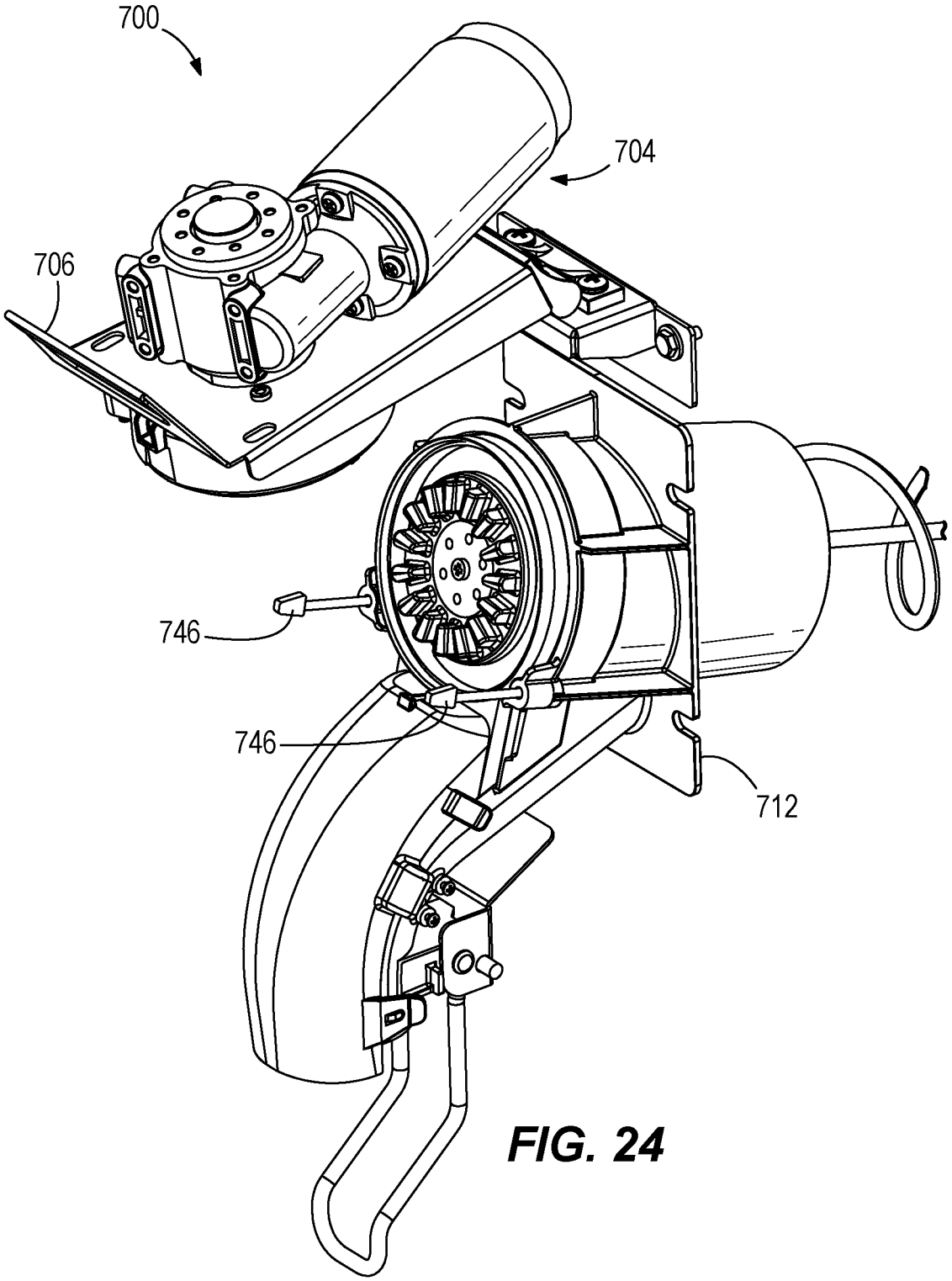
FIG. 24 is a perspective view of the auger drive assembly of FIG. 11 including twist threaded locks in the opened position.

Referring now to FIGS. 22-24, a mechanism for retaining the drive mounting plate 706 in the closed position is shown. Although in some implementations the drive assembly locking component 724 is a threaded fastener that is coupled to and rotates upwardly with the drive mounting plate 706, in other implementations, rotatable locking pins 746 may be utilized. FIG. 22 depicts the rotatable locking pins 746 in locked positions within slots 748 formed in the drive mounting plate 706. To rotate the drive mounting plate 706 and drive assembly into the opened position, each of the rotatable locking pins 746 may be rotated 90 degrees to an unlocked position to permit the slots 748 to travel past the locking pins 746, as depicted in FIG. 24. In an exemplary implementation, the pins 746 may be rotatably coupled to the ice chute 712. In other implementations, the pins 746 may be coupled to a different structural component (e.g., the valve base plate 808) of the auger drive assembly 700 or the ice dispenser 800.

Figure 25:
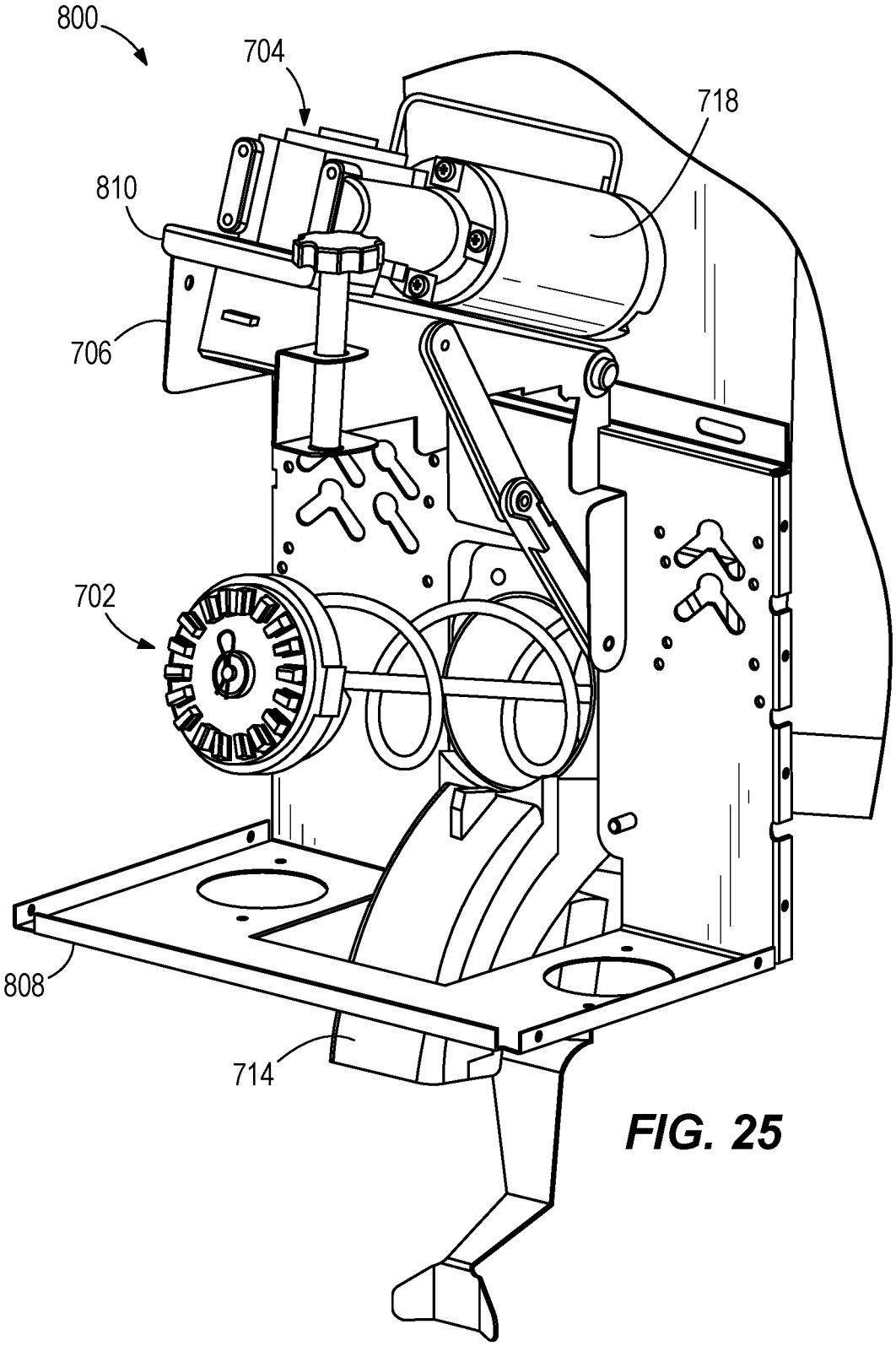
FIG. 25 is a perspective view of the auger drive assembly of FIG. 11 in a locked and opened position with the auger assembly partially removed.
Figure 26:
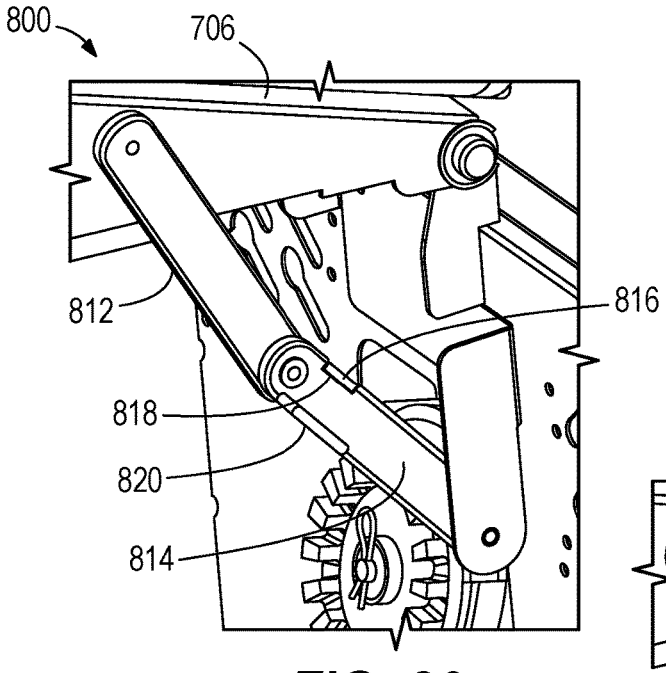
FIG. 26 is a perspective view of the locking bar linkages of the auger drive assembly of FIG. 11 in the locked and opened position.

Turning now to FIGS. 25-28, several views of the ice dispenser 800 in various positions intended to aid in the servicing of the auger assembly 702 and the drive assembly 704 are depicted. FIG. 25 depicts the ice dispenser 800 with the drive assembly 704 in the opened position and the auger assembly 702 exposed from its installation location within the ice bin structure 802. Upon rotating or otherwise releasing the drive assembly locking component 724, a technician may utilize a grip feature or handle 810 on the drive mounting plate 706 to rotate the drive assembly 704 and the drive mounting plate 706 upwards. To secure the drive assembly 704 and the drive mounting plate 706 in the opened position, a first locking member 812 and a second locking member 814 are shown to be coupled to the drive mounting plate 706 and a valve base plate 808. By securing the drive mounting plate 706 in the opened position, the technician is protected from injury that could occur should the drive mounting plate 706 suddenly release from the opened position and swing downwardly. As depicted in FIG. 26, once the drive assembly 704 and the drive mounting plate 706 have been locked into the opened position, the auger assembly 702 can be removed from the ice bin structure and passed through the valve base plate 808 for cleaning or servicing. Advantageously, no tools are required to remove the auger assembly 702.

Figure 27:
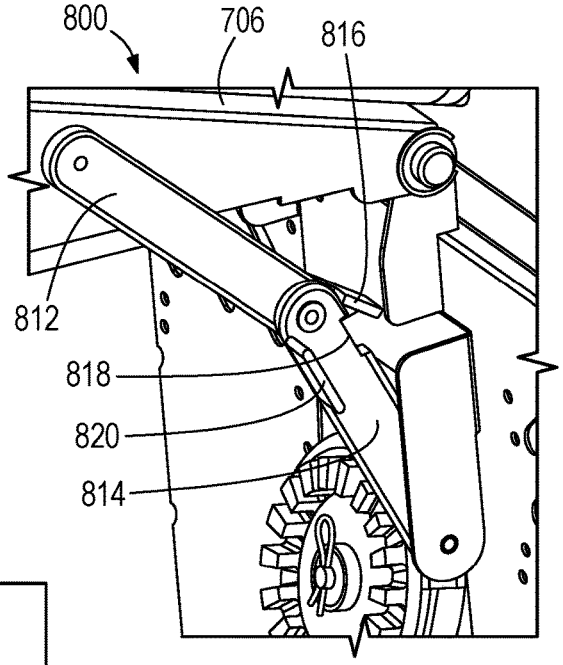
FIG. 27 is a perspective view of the locking bar linkages of the auger drive assembly of FIG. 11 in an unlocked and opened position.
Figure 28:
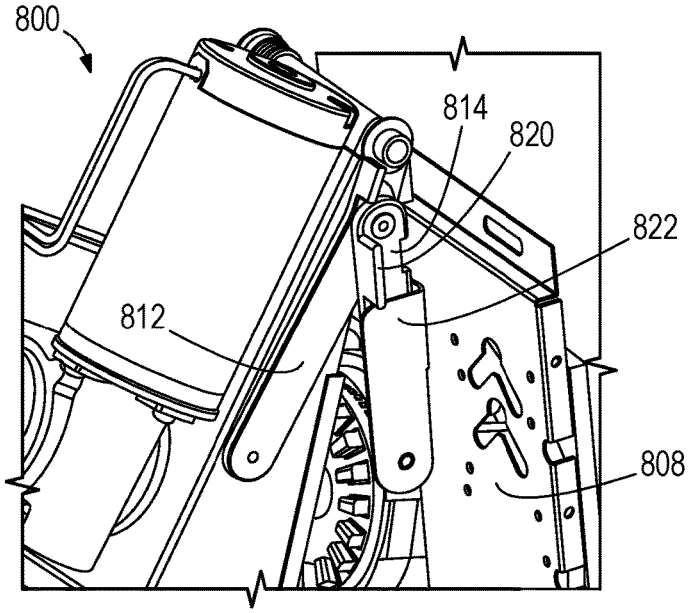
FIG. 28 is a perspective view of the locking bar linkages of the auger drive assembly of FIG. 11 in an unlocked and partially closed position.

FIGS. 26 and 27 depict engaging features of the first locking member 812 and the second locking member 814. As shown in FIG. 26, when the drive mounting plate 706 is in the fully opened position, a locking tab 816 of the first locking member 812 is fully seated within a corresponding slot 818 formed in the second locking member 814. To disengage the tab 816 from the slot 818, a technician can exert a force on a lever arm 820 of the second locking member 814 to cause the second locking member 814 to pivot upwardly. This pivoting movement causes the tab 816 to release from the slot 818, permitting the drive mounting plate 706 to rotate downwardly toward the closed position. A view of the ice dispenser 800 in a partially closed position is depicted in FIG. 28. As shown, after pivoting from the opened position to the partially closed position, the second locking member 814 is substantially aligned with a locking member bracket 822 that is coupled to the valve base plate 808.

The invention has been described in an illustrative manner. It is to be understood that the terminology which has been used is intended to be in the nature of words of description rather than limitation. Many modifications and variations of the invention are possible in light of the above teachings. Therefore, within the scope of the appended claims, the invention may be practiced other than as specifically described.

The invention claimed is:

1. An ice dispensing system comprising:

a plurality of sidewalls forming an ice bin cavity configured to store ice; and an auger drive assembly comprising:

a drive assembly coupled to one of the plurality of sidewalls and having a motor configured to rotate a drive gear; and an auger assembly positioned within the ice bin cavity and having a helical auger coupled to an auger gear, wherein the drive gear is configured to mate with the auger gear to drive rotation of the helical auger and cause ice to be dispensed through an ice chute; and wherein the drive assembly is movable relative to the auger assembly between a closed position and an opened position, the opened position configured to permit removal of the auger assembly from the ice bin cavity.

2. The ice dispensing system of claim 1, wherein the motor is coupled to a drive mounting plate.

3. The ice dispensing system of claim 2, wherein the drive mounting plate is coupled to the one of the plurality of sidewalls using a gravity hinge.

4. The ice dispensing system of claim 1, further comprising one or more drive assembly locking components configured to inhibit the drive assembly from moving from the closed position to the opened position.

5. The ice dispensing system of claim 4, wherein the one or more drive assembly locking components comprise locking pins, each locking pin configured to rotate 90 degrees between a locked position and an unlocked position.

6. The ice dispensing system of claim 1, wherein the auger assembly further comprises a tensioning rod configured to prevent compression of the helical auger.

7. The ice dispensing system of claim 1, wherein the drive gear and the auger gear comprise a plurality of internal teeth and a plurality of external teeth, and wherein the plurality of internal teeth and the plurality of external teeth are interdigitated when the drive gear is mated with the auger gear to permit the drive gear and the auger gear to rotate at the same rate.

8. The ice dispensing system of claim 7, wherein the plurality of internal teeth and the plurality of external teeth are radially symmetrical.

9. The ice dispensing system of claim 1, wherein the auger assembly further comprises an ice chute interface component positioned between the auger gear and the helical auger, the ice chute interface component configured to prevent contamination of ice by the auger gear.

10. The ice dispensing system of claim 1, further comprising a bearing pin positioned within the ice bin cavity, the bearing pin configured to align the auger assembly within the ice bin cavity.

11. The ice dispensing system of claim 1, further comprising an actuator lever positioned below the ice chute and configured to operate the motor.

12. An ice dispensing system comprising:

a plurality of sidewalls forming an ice bin cavity configured to store ice;

an inclined ice ramp located within the ice bin cavity and proximate a dispensing chute positioned at a front end of the ice bin cavity;

a helical auger positioned above the inclined ice ramp and configured to be rotated by a motor, wherein rotation of the helical auger in a first direction causes ice to be driven upwardly along the inclined ice ramp and to exit the ice dispensing system through the dispensing chute; and a baffle positioned above the helical auger and the inclined ice ramp, the baffle sloping downwardly from a rear end of the ice bin cavity to support a portion of the ice and thereby reduce a load exerted by the ice on the helical auger.

13. The ice dispensing system of claim 12, further comprising an ice bath region positioned below the inclined ice ramp.

14. The ice dispensing system of claim 13, wherein the ice bath region comprises a cold plate that is downwardly sloped from the front end to the rear end of the ice bin cavity.

15. The ice dispensing system of claim 14, wherein the cold plate is supported by a plurality of pedestals extending from a base surface of ice bin cavity such that the cold plate is spaced apart from the plurality of sidewalls.

16. The ice dispensing system of claim 13, wherein the inclined ice ramp comprises at least one ice bath chute configured to deposit ice into the ice bath region during rotation of the helical auger.

17. The ice dispensing system of claim 12, wherein operation of the motor is controlled by a motor control device.

18. The ice dispensing system of claim 17, wherein the motor control device is configured to operate the motor to rotate the helical auger in a second direction opposite the first direction.

19. The ice dispensing system of claim 18, wherein the helical auger is configured to be rotated by the motor in the second direction upon detection of a high motor current condition by the motor control device.

20. The ice dispensing system of claim 18, wherein the helical auger is configured to be rotated by the motor in the second direction according to an ice agitation schedule implemented by the motor control device.

21. The ice dispensing system of claim 20, wherein the ice agitation schedule comprises a configurable elapsed period from a last dispensing action.

22. The ice dispensing system of claim 17, wherein the motor control device is configured to detect a low motor current condition.

23. The ice dispensing system of claim 22, wherein the motor control device is configured to operate a low ice indicator upon detection of the low motor current condition.

24. The ice dispensing system of claim 12, wherein a capacity of the ice bin cavity ranges from 60 to 80 pounds.

25. The ice dispensing system of claim 12, wherein a ramp angle between the inclined ice ramp and a horizontal plane ranges from 5 to 35 degrees.

* * * * *